US008996363B2

(12) United States Patent
Disch et al.

(10) Patent No.: US 8,996,363 B2
(45) Date of Patent: Mar. 31, 2015

(54) APPARATUS AND METHOD FOR DETERMINING A PLURALITY OF LOCAL CENTER OF GRAVITY FREQUENCIES OF A SPECTRUM OF AN AUDIO SIGNAL

(75) Inventors: Sascha Disch, Fuerth (DE); Harald Popp, Tuchenbach (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 710 days.

(21) Appl. No.: 12/992,054

(22) PCT Filed: Mar. 18, 2010

(86) PCT No.: PCT/EP2010/053574
§ 371 (c)(1),
(2), (4) Date: May 13, 2011

(87) PCT Pub. No.: WO2010/112348
PCT Pub. Date: Oct. 7, 2010

(65) Prior Publication Data

US 2012/0008799 A1 Jan. 12, 2012

Related U.S. Application Data

(60) Provisional application No. 61/166,562, filed on Apr. 3, 2009.

(30) Foreign Application Priority Data

Aug. 28, 2009 (EP) ..... 09011091

(51) Int. Cl.
*G10L 19/02* (2013.01)
*G10L 25/90* (2013.01)
(Continued)

(52) U.S. Cl.
CPC ..... *G10L 25/90* (2013.01); *G10L 19/0204* (2013.01); *G10L 25/48* (2013.01); *G10L 19/02* (2013.01); *G10L 25/18* (2013.01)
USPC ..... 704/203; 704/200; 704/205; 704/206; 704/231

(58) Field of Classification Search
CPC ..... G10L 19/00; G10L 19/02; G10L 19/0204; G10L 19/0208; G10L 19/022; G10L 19/04; G10L 19/06; G10L 19/26
USPC ..... 704/203, 205, 200, 231, 206
See application file for complete search history.

(56) References Cited

U.S. PATENT DOCUMENTS 5,633,499 A * 5/1997 Lim et al. ..... 250/363.07
2002/0010399 A1* 1/2002 Konofagou et al. ..... 600/449
(Continued)

FOREIGN PATENT DOCUMENTS

JP 2004334160 11/2004
RU 2174714 10/2001

OTHER PUBLICATIONS

Potamianos et al. "speech analysis and synthesis using an AM-FM modulation model", Speech Communiation, Elsevier Science, Jan. 1999.*

(Continued)

*Primary Examiner* — Qi Han
(74) *Attorney, Agent, or Firm* — Michael A. Glenn; Perkins Coie LLP

(57) ABSTRACT

An apparatus for determining a plurality of local center-of-gravity frequencies of a spectrum of an audio signal includes an offset determiner, a frequency determiner and an iteration controller. The offset determiner determines an offset frequency for each iteration start frequency of a plurality of iteration start frequencies based on the spectrum of the audio signal, wherein a number of discrete sample values of the spectrum is larger than a number of iteration start frequencies. The frequency determiner determines a new plurality of iteration start frequencies by increasing or reducing each iteration start frequency of the plurality of iteration start frequencies by the corresponding determined offset frequency. The iteration controller provides the new plurality of iteration start frequencies to the offset determiner for further iteration or provides the plurality of local center-of-gravity frequencies, if a predefined termination condition is fulfilled.

22 Claims, 22 Drawing Sheets

(51) Int. Cl.
*G10L 25/48* (2013.01)
*G10L 25/18* (2013.01)

(56) References Cited

U.S. PATENT DOCUMENTS

| | | | | |
|---|---|---|---|---|
| 2003/0023153 | A1 * | 1/2003 | Izatt et al. | 600/407 |
| 2004/0059570 | A1 | 3/2004 | Mochinaga et al. | |
| 2007/0174049 | A1 | 7/2007 | Oh et al. | |

OTHER PUBLICATIONS

Annantharaman, J et al., "Intensity-Weighted Average of Instantaneous Frequency as a Model for Frequency Discrimination", Journal of Acoustical Society of America. vol. 94, No. 2., Aug. 1993, pp. 723-729.

Disch, S et al., "An Amplitude- and Frequency-Modulation Vocoder for Audio Signal Processing", Proc. of the 11th International Conference on Digital Audio Effects (DAx-08). Espoo, Finland., Sep. 1, 2008, pp. 1-8.

Disch, S et al., "An Iterative Segmentation Algorithm for Audio Signal Spectra Depending on Estimated Local Centers of Gravity", Proc. of the 12th International Conference on Digital Audio Effects (DAFx-09). Como, Italy., Sep. 1, 2009, pp. 1-6.

Klapuri, A et al., "Multiple Fundamental Frequency Estimation Based on Harmonicity and Spectral Smoothness", IEEE Transactions on Speech and Audio Processing. vol. 11, No. 6., Nov. 2003, pp. 804-816.

Nitanda, N et al., "Audio-Cut Detection and Audio-Segment Classification Using Fuzzy C-Means Clustering", ICASSP 2004. 0-7803-8484-9., 2004, pp. 325-328.

* cited by examiner

APPARATUS AND METHOD FOR DETERMINING A PLURALITY OF LOCAL CENTER OF GRAVITY FREQUENCIES OF A SPECTRUM OF AN AUDIO SIGNAL

CROSS-REFERENCE TO RELATED APPLICATION

This application is a U.S. National Phase entry of PCT/EP2010/053574 filed Mar. 18, 2010, and claims priority to U.S. Patent Application No. 61/166,562 filed Apr. 3, 2009, and European Patent Application No. 09011091.7 filed Aug. 28, 2009, each of which is incorporated herein by references hereto.

BACKGROUND OF THE INVENTION

Embodiments according to the invention relate to audio signal processing systems and, more particularly, to an apparatus and a method for determining a plurality of local center-of-gravity frequencies of a spectrum of an audio signal, the plurality of local center-of-gravity frequencies comprising a multitude of local center-of-gravity frequencies.

There is an increasing demand for digital signal processing techniques that address the need for extreme signal manipulations in order to fit pre-recorded audio signals, e.g. taken from a database, into a new musical context. In order to do so, high level semantic signal properties like pitch, musical key and scale mode are needed to be adapted. All these manipulations have in common that they aim at substantially altering the musical properties of the original audio material while preserving subjective sound quality as good as possible. In other words, these edits strongly change the audio material musical content but, nevertheless, are necessitated to preserve the naturalness of the processed audio sample and thus maintain believability. This ideally necessitates signal processing methods that are broadly applicable to different classes of signals including polyphonic mixed music content.

Therefore, a method for analysis, manipulation and synthesis of audio signals based on multiband modulation components has been proposed lately (see "S. Disch and B. Edler, "An amplitude- and frequency modulation vocoder for audio signal processing." Proc. of the Int. Conf. on Digital Audio Effects (DAFx). 2008", "S. Disch and B. Edler, "Multiband perceptual modulation analysis, processing and synthesis of audio signals," Proc. of the IEEE-ICASSP, 2009"). The fundamental idea of this approach is to decompose polyphonic mixtures into components that are perceived as sonic entities anyway, and to further manipulate all signal elements that are contained in one component in a joint fashion. Additionally, a synthesis method has been introduced that renders a smooth and perceptually pleasant yet—depending on the type of manipulation applied—drastically modified output signal. If no manipulation whatsoever is applied to the components the method has been shown to provide transparent or near-transparent subjective audio quality (see "S. Disch and B. Edler, "An amplitude- and frequency modulation vocoder for audio signal processing," Proc. of the Int. Conf. on Digital Audio Effects (DAFx), 2008") for many test signals.

An important step for a block based polyphonic music manipulation, e.g. the multiband modulation decomposition, is the estimation of local centers of gravity (COG) (see "J. Anantharaman, A. Krishnamurthy, and L. Feth, "Intensity-weighted average of instantaneous frequency as a model for frequency discrimination.," J. Acoust. Soc. Am., vol. 94, pp. 723-729, 1993", "Q. Xu, L. L. Feth, J. N. Anantharaman, and A. K. Krishnamurthy, "Bandwidth of spectral resolution for the "c-o-g" effect in vowel-like complex sounds," Acoustical Society of America Journal, vol. 101, pp. 3149-+, May 1997") in successive spectra over time. This document shows an iterative algorithm, that can be used to determine a signal adaptive spectral decomposition that is aligned with local COG of the signal.

The COG approach may be reminiscent of the classic time frequency reassignment (t-f reassignment) method. For an extensive overview on this technique the reader is referred to (see "A. Fulop and K. Fitz, "Algorithms for computing the time corrected instantaneous frequency (reassigned) spectrogram, with applications", Journal of the Acoustical Society of America, vol. 119, pp. 360-371, 2006"). Basically, t-f reassignment alters the regular time-frequency grid of a conventional Short Time Fourier Transform (STFT) towards a time-corrected instantaneous frequency spectrogram, thereby revealing temporal and spectral accumulations of energy that are better localized than implicated by the t-f resolution compromise inherent in the STFT spectrogram. Often, reassignment is used as an enhanced front-end for subsequent partial tracking (see "K. Fitz and L. Haken, "On the use of time-frequency reassignment in additive sound modeling", Journal of the Audio Engineering Society, vol. 50(11), pp. 879-893, 2002").

Other related publications aim at the estimation of multiple fundamental frequencies (see "A Klapuri, Signal Processing Methods For the Automatic Transcription of Music, Ph.D. thesis, Tampere University of Technology, 2004", "Chunghsin Yeh, Multiple fundamental frequency estimation of polyphonic recordings, Ph.D. thesis, École doctorale edité, Université de Paris, 2008") by grouping spectral peaks which exhibit certain harmonic relations into separate sources. However, for complex music composed of many sources (like orchestral music), this approach has no reasonable chance.

In some applications vocoders are used for signal manipulation. One class of vocoders are phase vocoders. A tutorial on phase vocoders is the publication ""The Phase Vocoder: A tutorial", Mark Dolson, Computer Music Journal, Volume 10, No. 4, pages 14 to 27, 1986". An additional publication is ""New phase vocoder techniques for pitch-shifting, harmonizing and other exotic effects", L. Laroche and M. Dolson, proceedings 1999, IEEE workshop on applications of signal processing to audio and acoustics, New Paltz, N.Y., Oct. 17 to 20, 1999, pages 91 to 94".

FIGS. 17 and 18 illustrate different implementations and applications for a phase vocoder. FIG. 17 illustrates a filter bank implementation of a phase vocoder 1700, in which an audio signal is provided at an input 500, and where, at an output 510, a synthesized audio signal is obtained. Specifically, each channel of the filter bank illustrated in FIG. 17 comprises a band pass filter 501 and a subsequently connected oscillator 502. Output signals of all oscillators 502 from all channels are combined via a combiner 503, which is illustrated as an adder. At the output of the combiner 503, the output signal 510 is obtained.

Each filter 501 is implemented to provide, on the one hand, an amplitude signal A(t), and on the other hand, the frequency signal f(t). The amplitude signal and the frequency signal are time signals. The amplitude signal illustrates a development of the amplitude within a filter band over time and the frequency signal illustrates the development of the frequency of a filter output signal over time.

As schematic implementation of a filter 501 is illustrated in FIG. 18. The incoming signal is routed into two parallel paths. In one path, the signal is multiplied by a sine wave with an amplitude of 1.0 and a frequency equal to the center frequency of the band pass filter as illustrated at 551. In the other path, the signal is multiplied by a cosine wave of the same amplitude and frequency as illustrated at 551. Thus, the two parallel paths are identical except for the phase of the multiplying wave form. Then, in each path, the result of the multiplication is fed into a low pass filter 553. The multiplication operation itself is also known as a simple ring modulation. Multiplying any signal by a sine (or cosine) wave of constant frequency has the effect of simultaneously shifting all the frequency components in the original signal by both plus and minus the frequency of the sine wave. If this result is now passed through an appropriate low pass filter, only the low frequency portion will remain. This sequence of operations is also known as heterodyning. This heterodyning is performed in each of the two parallel paths, but since one path heterodynes with a sine wave, while the other path uses a cosine wave, the resulting heterodyned signals in the two paths are out of phase by 90°. The upper low pass filter 553, therefore, provides a quadrate signal 554 and the lower filter 553 provides an in-phase signal. These two signals, which are also known as I and Q signals, are forwarded into a coordinate transformer 556 which generates a magnitude/phase representation from the rectangular representation.

The amplitude signal is output at 557 and corresponds to A(t) from FIG. 17. The phase signal is input into a phase unwrapper 558. At the output of element 558 there does not exist a phase value between 0 and 360° but a phase value which increases in a linear way. This "unwrapped" phase value is input into a phase/frequency converter 559 which may, for example, be implemented as a phase-difference-device which subtracts a phase at a preceding time instant from phase at a current time instant in order to obtain the frequency value for the current time instant.

This frequency value is added to a constant frequency value $f_i$ of the filter channel i, in order to obtain a time-varying frequency value at an output 560.

The frequency value at the output 560 has a DC portion $F_i$ and a changing portion which is also known as the "frequency fluctuation", by which a current frequency of the signal in the filter channel deviates from the mean frequency $F_i$.

Thus, the phase vocoder as illustrated in FIG. 5 and FIG. 6 provides a separation of spectral information and time information. The spectral information is comprised in the specific filter bank channel and in the frequency $f_i$, and the time information is in the frequency fluctuation and in the magnitude over time.

Another description of the phase vocoder is the Fourier transform interpretation. It consists of a succession of overlapping Fourier transforms taken over finite-duration windows in time. In the Fourier transform interpretation, attention is focused on the magnitude and phase values for all of the different filter bands or frequency bins at the single point in time. While in the filter bank interpretation, the re-synthesis can be seen as a classic example of additive synthesis with time varying amplitude and frequency controls for each oscillator, the synthesis, in the Fourier implementation, is accomplished by converting back to real-and-imaginary form and overlap-adding the successive inverse Fourier transforms. In the Fourier interpretation, the number of filter bands in the phase vocoder is the number of points in the Fourier transform. Similarly, the equal spacing in frequency of the individual filters can be recognized as the fundamental feature of the Fourier transform. On the other hand, the shape of the filter pass bands, i.e., the steepness of the cutoff at the band edges is determined by the shape of the window function which is applied prior to calculating the transform. For a particular characteristic shape, e.g., Hamming window, the steepness of the filter cutoff increases in direct proportion to the duration of the window.

It is useful to see that the two different interpretations of the phase vocoder analysis apply only to the implementation of the bank of band pass filters. The operation by which the outputs of these filter are expressed as time-varying amplitudes and frequencies is the same for both implementations. The basic goal of the phase vocoder is to separate temporal information from spectral information. The operative strategy is to divide the signal into a number of spectral bands and to characterize the time-varying signal in each band.

Two basic operations are particularly significant. These operations are time scaling and pitch transposition. It is possible to slow down a recorded sound simply by playing it back at a lower sample rate. This is analogous to playing a tape recording at a lower playback speed. But, this kind of simplistic time expansion simultaneously lowers the pitch by the same factor as the time expansion. Slowing down the temporal evolution of a sound without altering its pitch necessitates an explicit separation of temporal and spectral information. As noted above, this is precisely what the phase vocoder attempts to do. Stretching out the time-varying amplitude and frequency signals A(t) and f(t) to FIG. 5*a* does not change the frequency of the individual oscillators at all, but it does slow down the temporal evolution of the composite sound. The result is a time-expanded sound with the original pitch. The Fourier transform view of time scaling is so that, in order to time-expand a sound, the inverse FFTs can simply be spaced further apart than the analysis FFTs. As a result, spectral changes occur more slowly in the synthesized sound than in the original in this application, and the phase is resealed by precisely the same factor by which the sound is being time-expanded.

The other application is pitch transposition. Since the phase vocoder can be used to change the temporal evolution of a sound without changing its pitch, it should also be possible to do the reverse, i.e., to change the pitch without changing the duration. This is done by time-scale using the desired pitch-change factor and then to play the resulting sounds back at a sample rate modified by the same factor. For example, to raise the pitch by an octave, the sound is first time-expanded by a factor of 2 and the time-expansion is then played at twice the original sample rate.

An application of vocoders for processing audio signals is shown for example in "Sascha Disch, Bernd Edler: "An Amplitude- and Frequency-Modulation Vocoder for Audio Signal Processing", Proceedings of the $11^{th}$ International Conference on Digital Audio Effects (DAFx-08), Espoo, Finland, Sep. 1-4, 2008". In this document local center of gravity candidates are estimated by searching positive to negative transitions in a center of gravity position function. For this, the center of gravity position function is calculated for each value of the spectrum (for example for each spectral amplitude value or each power density value) for each time block of the audio signal. In this context, block sizes of $N=2^{14}$ values at 48 kHz sample frequency are mentioned. Therefore, the computational efforts for estimating the local center of gravity candidates are very high.

Additionally a post-selection procedure is necessitated to ensure that the final estimated center of gravity positions are approximately equidistant on a perceptual scale.

SUMMARY

According to an embodiment, an apparatus for determining a plurality of local center-of-gravity frequencies of a spectrum of an audio signal may have: an offset determiner configured to determine an offset frequency for each iteration start frequency of a plurality of iteration start frequencies based on the spectrum of the audio signal, wherein a number of discrete sample values of the spectrum is larger than a number of iteration start frequencies; a frequency determiner configured to determine a new plurality of iteration start frequencies by increasing or reducing each iteration start frequency of the plurality of iteration start frequencies by the corresponding determined offset frequency; and an iteration controller configured to provide the new plurality of iteration start frequencies to the offset determiner for a further iteration or to provide the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies.

According to another embodiment, a signal adaptive filterbank for filtering an audio signal may have: an inventive apparatus for determining a plurality of local center-of-gravity frequencies of a spectrum of the audio signal, the plurality of local center-of-gravity frequencies comprising a multitude of local center-of-gravity frequencies; and a plurality of bandpass filters configured to filter the audio signal to obtain a filtered audio signal and to provide the filtered audio signal, wherein a center frequency and a bandwidth of each bandpass filter of the plurality of bandpass filters is based on the plurality of local center-of-gravity frequencies.

Another embodiment may have a phase vocoder having an inventive signal adaptive filterbank.

According to another embodiment, an apparatus for converting an audio signal into a parameterized representation may have: an inventive apparatus for determining a plurality of local center-of-gravity frequencies of a spectrum of the audio signal, the plurality of local center-of-gravity frequencies comprising a multitude of local center-of-gravity frequencies; a bandpass estimator for estimating information of a plurality of bandpass filters based on the plurality of local center-of-gravity frequencies, wherein the information on the plurality of bandpass filters includes information on a filter shape for the portion of the audio signal, wherein the bandwidth of a bandpass filter is different over an audio spectrum; a modulation estimator for estimating an amplitude modulation or a frequency modulation or a phase modulation for each band of the plurality of bandpass filters for the portion of the audio signal using the information on the plurality of bandpass filters; and an output interface for transmitting, storing or modifying information on the amplitude modulation, information on the frequency modulation or phase modulation or the information on the plurality of bandpass filters for the portion of the audio signal.

According to another embodiment, a method for determining a plurality of local center-of-gravity frequencies of a spectrum of an audio signal, the plurality of local center-of-gravity frequencies comprising a multitude of local center-of-gravity frequencies, may have the steps of: determining an offset frequency for each iteration start frequency of a plurality of iteration start frequencies based on the spectrum of the audio signal, wherein a number of discrete sample values of the spectrum is larger than a number of iteration start frequencies; determining a new plurality of iteration start frequencies by increasing or reducing each iteration start frequency of the plurality of iteration start frequencies by the corresponding determined offset frequency; and providing the new plurality of iteration start frequencies for a further iteration or providing the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies.

Another embodiment may have a computer program with a program code for performing the inventive method, when the computer program runs on a computer or a microcontroller.

Embodiments according to the invention are based on the central idea that offset frequencies are determined for a plurality of iteration start frequencies and then the iteration start frequencies are updated by their determined offset frequencies. This is done iteratively until a predefined termination condition is fulfilled. Since the number of iteration start frequencies is lower than the number of discrete sample values of the spectrum, the computational complexity is significantly reduced in comparison to known concepts.

For example, the number of iteration start frequencies may be between 10 and 100. This is, for example, significantly less than the number of discrete sample values of an $N=2^{14}$ mentioned above. In this example, the computational efforts may be reduced by a factor of more than 100.

Additionally, the spectral resolution may be easily adapted by varying the number of iteration start frequencies and/or adapting the offset frequency calculation parameters.

Some embodiments according to the invention comprise a frequency merger. The frequency merger merges two adjacent iteration start frequencies of the plurality of iteration start frequencies, if a frequency distance between the two adjacent iteration start frequencies is smaller than a minimum frequency distance.

Some further embodiments according to the invention comprise a frequency adder. The frequency adder adds an iteration start frequency to the plurality of iteration start frequencies, if a frequency distance between two adjacent iteration start frequencies of the plurality of iteration start frequencies is larger than a maximum frequency distance. For example, this may be useful, if an initialization is done by a previous (time) block's estimate.

Some embodiments according to the invention relate to a method for determining a plurality of local center-of-gravity frequencies of a spectrum of an audio signal, the plurality of local center-of-gravity frequencies comprising a multitude of local center-of-gravity frequencies, according to an embodiment of the invention. The method comprises determining an offset frequency for each iteration start frequency of a plurality of iteration start frequencies, determining a new plurality of iteration start frequencies and providing the new plurality of iteration start frequencies for a further iteration or providing the plurality of local center-of-gravity frequencies. The offset frequency for each iteration start frequency of the plurality of iteration start frequencies is determined based on the spectrum of the audio signals, wherein a number of discrete sample values of the spectrum is larger than a number of iteration start frequencies. The new plurality of iteration start frequencies is determined by increasing or reducing each iteration start frequency of the plurality of iteration start frequencies by the corresponding determined offset frequency. The plurality of local center-of-gravity frequencies is provided for storage, transmission or further processing, if a predefined determination condition is fulfilled. For this, a number of the multitude of local center-of-gravity frequencies of the plurality of local center-of-gravity frequencies is equal to a number of iteration start frequencies of the new plurality of iteration start frequencies.

In some embodiments according to the invention the plurality of local center-of-gravity frequencies determined for a previous time block of the audio signal are used as iteration start frequencies for the first iteration of the next time block of the audio signal. In this case, large gaps between the iteration start frequencies may be filled by the frequency adder.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
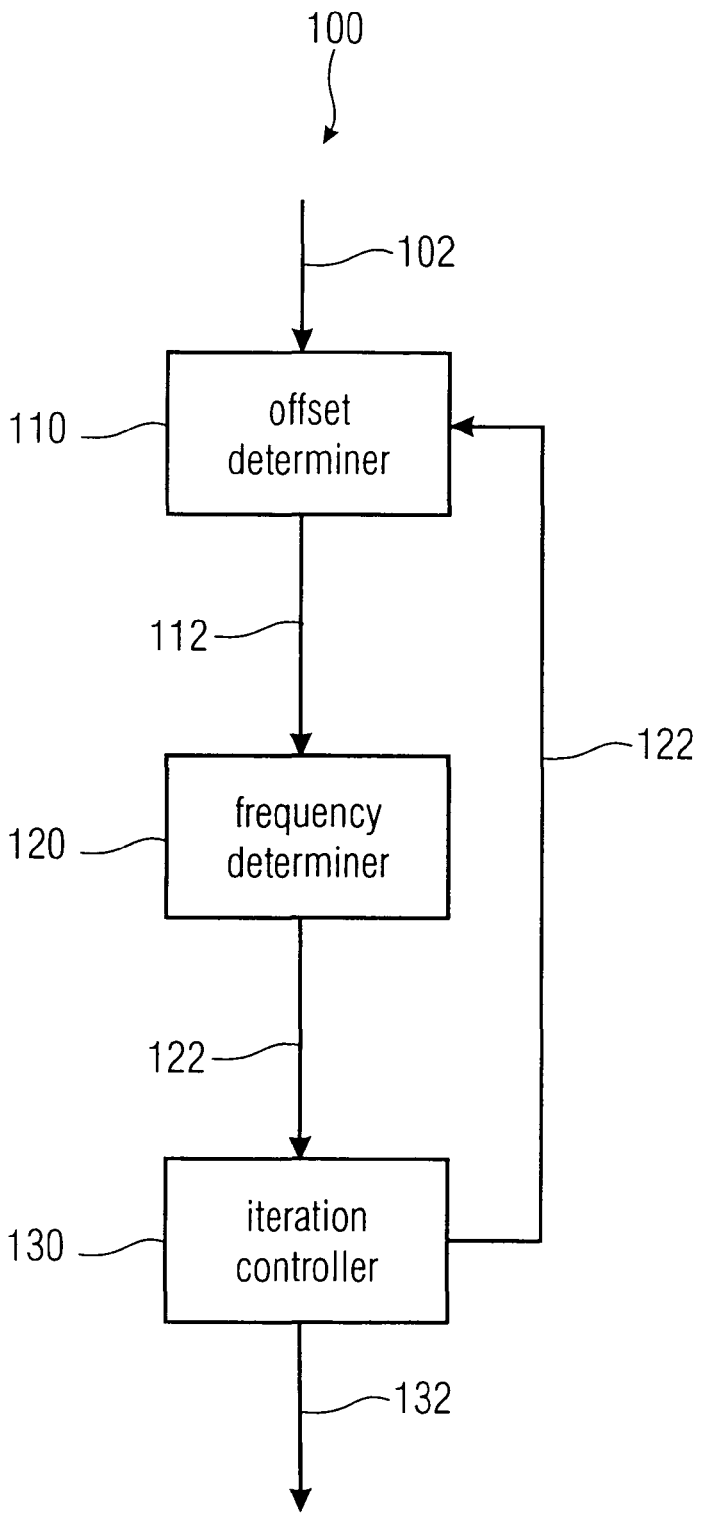
FIG. 1 is a block diagram of an apparatus for determining a plurality of local center-of-gravity frequencies.

In the following, the same reference numerals are partly used for objects and functional units having the same or similar functional properties and the description thereof with regard to a figure shall apply also to other figures in order to reduce redundancy in the description of the embodiments.

FIG. 1 shows a block diagram of an apparatus 100 for determining a plurality of local center-of-gravity frequencies 132 of a spectrum 102 of an audio signal, the plurality of local center-of-gravity frequencies comprising a multitude of local center-of-gravity frequencies, according to an embodiment of the invention. The apparatus 100 comprises an offset determiner 110, a frequency determiner 120 and an iteration controller 130. The offset determiner 110 is connected to the frequency determiner 120, the frequency determiner 120 is connected to the iteration controller 130 and the iteration controller 130 is connected to the offset determiner 110. The offset determiner 110 determines an offset frequency 112 for each iteration start frequency of a plurality of iteration start frequencies based on the spectrum 102 of the audio signal. The spectrum 102 is represented by discrete sample values, wherein a number of sample values of the spectrum 102 is larger than a number of iteration start frequencies. The frequency determiner 120 determines a new plurality of iteration start frequencies 122 by increasing or reducing each iteration start frequency of the plurality of iteration start frequencies by the corresponding determined offset frequency 112. Then, the iteration controller 130 provides the new plurality of iteration start frequencies 122 to the offset determiner 110 for a further iteration. Alternatively or additionally, the plurality of local center-of-gravity frequencies 132 is provided, if a predefined termination condition is fulfilled, wherein a number of the multitude of local center-of-gravity frequencies of the plurality of local center-of-gravity frequencies 132 is equal or is set equal to a number of iteration start frequencies of the new plurality of iteration start frequencies 122.

Since the number of iteration start frequencies is lower than the number of discrete sample values of the spectrum, the computational efforts for determining the plurality of local center-of-gravity frequencies 132 is reduced in comparison to concepts determining the local center-of-gravity frequencies based on functions, which have to be calculated for each discrete sample value of the spectrum.

The resolution and/or the accuracy of the determination of the local center-of-gravity frequency may be adapted to the particular application by varying the number of iteration start frequencies and/or the offset frequency calculation parameters. In this way also the computational effort varies, but since the number of iteration start frequencies is usually clearly below the number of discrete sample values of the spectrum, a low computational complexity may be guaranteed.

For example, the discrete sample values of the spectrum 102 may be spectral amplitudes, power spectral density values or other values obtained by a Fourier transformation of the audio signal. The number of discrete sample values of spectrum 102 for a time block of the audio signal may lie, for example, between 1,000 and 100,000 or between $2^9$ and $2^{20}$. By contrast, the number of iteration start frequencies may lie, for example, between 5 and 500. This large difference between the number of discrete sample values of the spectrum 102 and the number of iteration start frequencies allows the significant reduction of computational complexity in comparison to known methods.

A local center-of-gravity frequency 132 may be a frequency at which the spectrum 102 of the audio signal may comprise, for example, a local maximum or a local aggregation of spectrum amplitude or the power spectral density or another value obtained by a Fourier transformation of the audio signal.

For example, the plurality of iteration start frequencies may be equally or according to a distribution function or a given distribution spaced from each other over the spectrum 102 for the first iteration. Based on this iteration start frequencies and the spectrum 102, the offset determiner 110 determines the offset frequencies 112, which may be an indication of how far away from the local center of gravity an iteration start frequency is located. Therefore, the frequency determiner 120 tries to compensate this distance between the local center of gravity and the iteration start frequency by increasing or reducing (depending on a positive or negative value of the offset frequency) the iteration start frequency by the corresponding determined offset frequencies. Then the new plurality of iteration start frequencies 122 is provided to the offset determiner 110 for a further iteration or the new plurality of iteration start frequencies 122 is provided as the plurality of local center-of-gravity frequencies 132 to be determined, if a predefined termination condition is fulfilled.

The apparatus 100 may determine a plurality of local center-of-gravity frequencies 132 for each time block of a plurality of time blocks of the audio signal. In other words, the audio signal may be processed in time blocks. For each time block a spectrum 102 may be generated by a Fourier transformation and a plurality of local center-of-gravity frequencies 132 may be determined.

Possible predefined termination conditions may be for example that each offset frequency is below a maximum offset frequency, that the sum of all offset frequencies is below a maximum offset frequency sum or that the sum of the offset frequency determined for the current time block and the offset frequency determined for a previous time block is lower than a threshold offset.

The spectrum 102 provided to the offset determiner 110 may comprise, for example, a linear or logarithmic scale. For example, the plurality of iteration start frequencies may be distributed equally spaced over a over an logarithmic spectrum 102 for the first iteration to set a tendency for the determination of the plurality of local center-of-gravity frequencies 132, so that determined plurality of center-of-gravity frequencies 132 may be distributed on a perceptual scale.

The offset determiner 110, the frequency determiner 120 and the iteration controller 130 may be independent hardware units, part of a digital signal processor, a micro controller or a computer or they may be realized as a computer program or a computer program product configured to run on a micro controller or computer.

Figure 2:
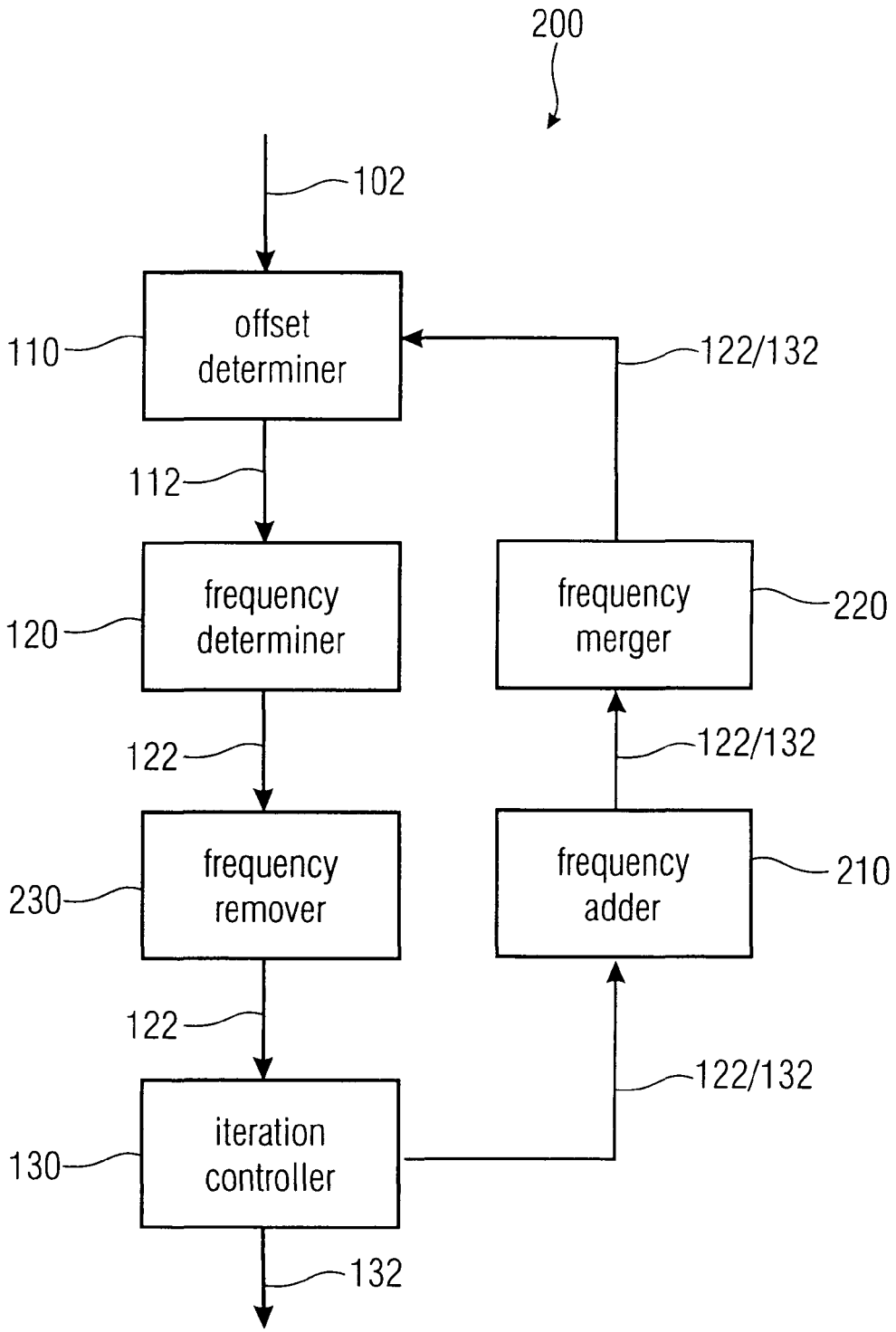
FIG. 2 is a block diagram of an apparatus for determining a plurality of local center-of-gravity frequencies.

FIG. 2 shows a block diagram of an apparatus 200 for determining a plurality of local center-of-gravity frequencies 132 of a spectrum 102 of an audio signal according to an embodiment of the invention. The apparatus 200 is similar to the apparatus shown in FIG. 1, but comprises additionally a frequency adder 210, a frequency merger 220 and a frequency remover 230. In this example, the frequency determiner 120 is connected to the frequency remover 230, the frequency remover 230 is connected to the iteration controller 130, the iteration controller 130 is connected to the frequency adder 210, the frequency adder 210 is connected to the frequency merger 220 and the frequency merger 220 is connected to the offset determiner 110. Alternatively, the positions of the frequency adder 210 and the frequency merger 220 may be changed and/or the frequency remover 230 may be arranged between the iteration controller 130 and the frequency adder 210, between the frequency adder 210 and the frequency merger 220 or between the frequency merger 220 and the offset determiner 110.

The frequency adder 210 may add an iteration start frequency to the new plurality of iteration start frequencies 122, if the frequency distance between two adjacent iteration start frequencies of the new plurality of iteration start frequencies 122 is larger than a maximum frequency distance. For this, the frequency distance and the maximum frequency distance may be measured on a linear or logarithmic scale.

In other words, the frequency adder 210 adds an iteration start frequency if a gap between two adjacent iterations start frequencies is too large. For example, this may be especially of interest if the plurality of local center-of-gravity frequency 132 determined for the current time block is provided to the offset determiner 110 to be used as plurality of iteration start frequencies for the first iteration of the next time block. But also during the iterations for the same time block an iteration start frequency may be added.

The plurality of local center-of-gravity frequencies can be utilized as a basis for generating a new plurality of iteration start frequencies.

The plurality of iteration start frequencies for the first iteration of a time block may be, for example, equally spaced from each other, as described before, or the determined plurality of local center-of-gravity frequencies 132 determined for the previous time block of the audio signal may be used as iteration start frequencies for the first iteration of the current time block.

The frequency merger 220 merges two adjacent iteration start frequencies of the new plurality of iteration start frequencies 122 if a frequency distance between the two adjacent iteration start frequencies is smaller than a minimum frequency distance. Once again, the frequency distance and the minimum frequency distance may be measured on a linear or logarithmic scale.

In other words, the frequency merger 220 may replace two adjacent iteration start frequencies by one iteration start frequency if the distance between the two adjacent iteration start frequencies is lower than a limit.

The frequency remover 230 removes an iteration start frequency from the new plurality of iteration start frequencies 132 if the iteration start frequency is higher than a predefined maximum frequency of the spectrum 102 of the audio signal or if the iteration start frequency is lower than a predefined minimum frequency of the spectrum 102 of the audio signal. For example, the predefined maximum frequency may be the highest frequency comprised by the spectrum 102 and the predefined minimum frequency may be the lowest frequency comprised by the spectrum 102.

In other words, the frequency remover 230 removes iteration start frequencies from the new plurality of iteration start frequencies 122, if they are located outside of the frequency range of the spectrum 102 of the audio signal.

The frequency adder 210 and the frequency remover 230 are optional units of the apparatus 200.

The frequency adder 210, the frequency merger 220 and the frequency remover 230 may be independent hardware units or integrated as mentioned for the offset determiner 110, the frequency determiner 120 and the alteration controller 130.

Figure 3:
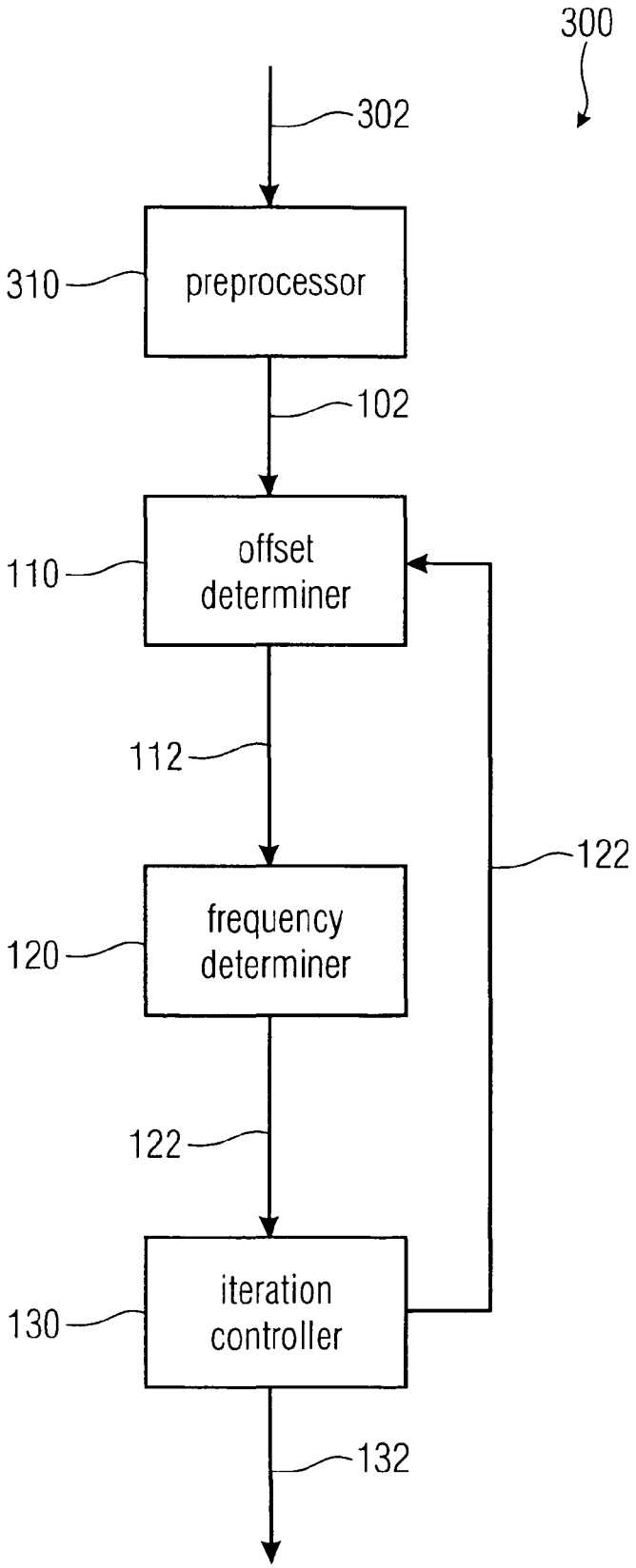
FIG. 3 is a block diagram of an apparatus for determining a plurality of local center-of-gravity frequencies using a preprocessing.

FIG. 3 shows a block diagram of an apparatus 300 for determining a plurality of local center-of-gravity frequencies 132 of a spectrum 102 of an audio signal 302 according to an embodiment of the invention. The apparatus 300 is similar to the apparatus shown in FIG. 1, but comprises additionally a preprocessor 310. The preprocessor 310 is connected to the offset determiner 110. The preprocessor 310 generates a Fourier transformation spectrum for a time block of the audio signal 302 and generates a smoothed spectrum based on the Fourier transformation spectrum of the time block. Further, the preprocessor 310 generates the spectrum 102 of the audio signal 302 to be provided to the offset determiner 110 by dividing the Fourier transformation spectrum by the smoothed spectrum. Then, the preprocessor 310 maps the spectrum to a logarithmic scale and provides the logarithmic spectrum 102 to the offset determiner 110. Alternatively, the preprocessor 310 may map the Fourier transformation spectrum to a logarithmic scale before generating the smoothed spectrum and before dividing the Fourier transformation spectrum by the smoothed spectrum.

In some embodiments, for each signal block (time block), a power spectral density (psd) estimate is obtained by computing the DFT spectral energy. Subsequently, in order to remove the global trend, the psd is normalized on a smoothed psd that is calculated, for example, by fitting a low order polynomial, performing cepstral smoothing or by filtering along frequency direction. Prior to division, both quantities may be also temporally smoothed, for example, by a first order IIR filter with time constant of, for example, 200 ms. Next, a mapping of the psd is performed onto a perceptual scale (logarithmic scale) prior to COG calculation and segmentation, for example, in order to facilitate the task of segmenting a spectrum into perceptually adapted non-uniform and, at the same time, COG centered bands. Thereby the problem may be simplified to the task of an alignment of a set of approximately uniform segments with the estimated local COG positions of the signal. As a perceptual scale the ERB scale (see "B. C. J. Moore and B. R. Glasberg, "A revision of Zwicker's loudness model," Acta Acustica, vol. 82, pp. 335-345, 1996") may be applied which provides better spectral resolution at lower frequencies than e.g. the BARK scale. However, the BARK scale may also be used. The mapped spectrum may be calculated by interpolation of the uniformly sampled spectrum towards spectral samples that are spaced following the ERB scale (see equation 2).

$$ERB(f)=21.4\log_{10}(0.00437f+1) \tag{2}$$

Alternatively, For each signal block, a power spectral density (psd) estimate is obtained by computing the DFT spectral energy. Next, a mapping of the psd is performed onto a perceptual scale prior to COG calculation and segmentation in order to facilitate the task of segmenting a spectrum into perceptually adapted non-uniform and, at the same time, COG centered bands. Thereby the problem is simplified to the task of an alignment of a set of approximately uniform segments with the estimated local COG positions of the signal. As a perceptual scale the ERB scale is applied which provides better spectral resolution at lower frequencies than e.g. the BARK scale. The mapped spectrum is calculated by interpolation of the uniformly sampled spectrum towards spectral samples that are spaced following the ERB scale (see equation 2).

Subsequently, in order to remove the global trend inherent in real-world audio signal spectra, the mapped psd is normalized on its trend which is calculated by linear regression minimizing a least squares criterion. Prior to division, both quantities are temporally smoothed by application of, for example, first order IIR_filters H (z), each having a time constant of, for example, $\tau$=200 ms as defined by equations 2a, where T is the DFT subband sample period given by the input sample period times the temporal stride of the DFT.

$$H(z)=\frac{1}{1-a_1z^{-1}} \tag{2a}$$

$$a_1=\exp\left(-\frac{T}{\tau}\right)$$

These pre-processing steps may prevent a global bias towards low frequencies in the subsequent COG position iteration and stabilize the estimated positions for temporally successive blocks, respectively.

Figure 3A:
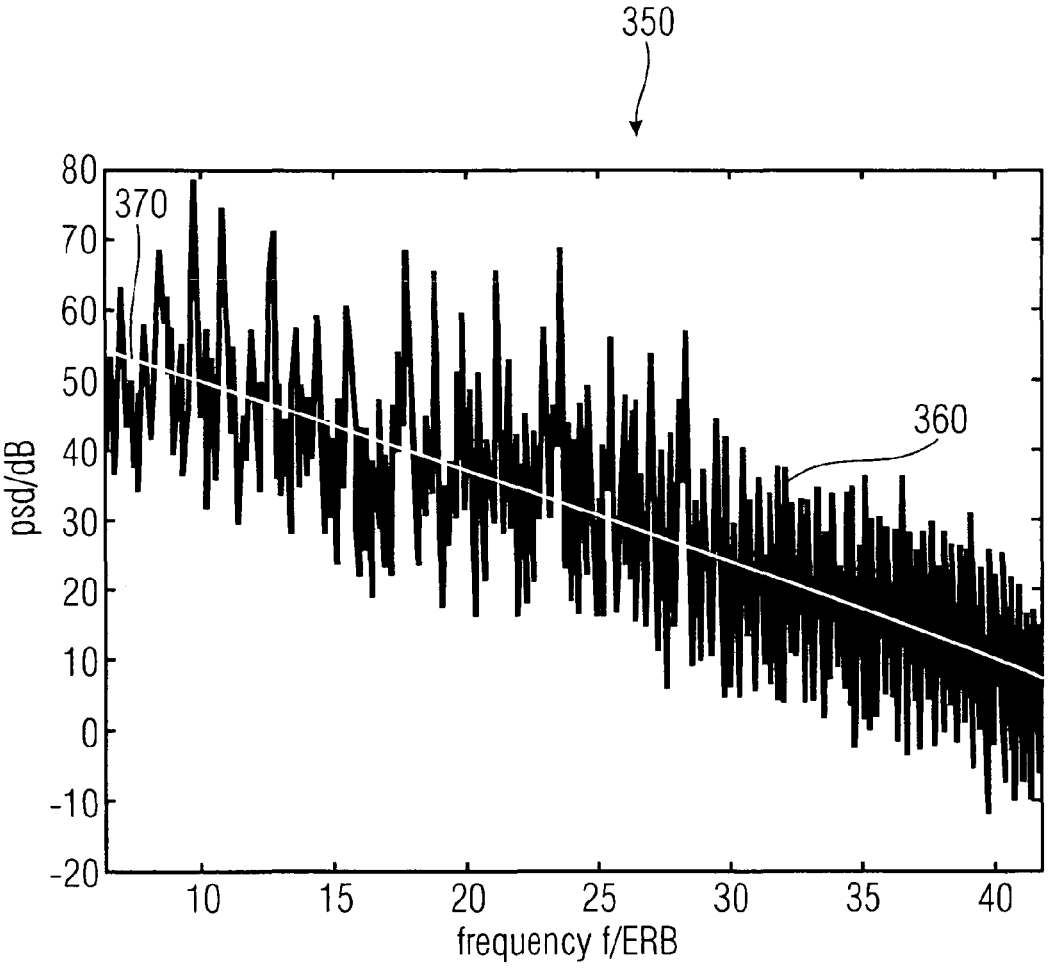
FIG. 3*a* is a diagram of a mapped spectrum vs. smoothed spectrum.
Figure 4:
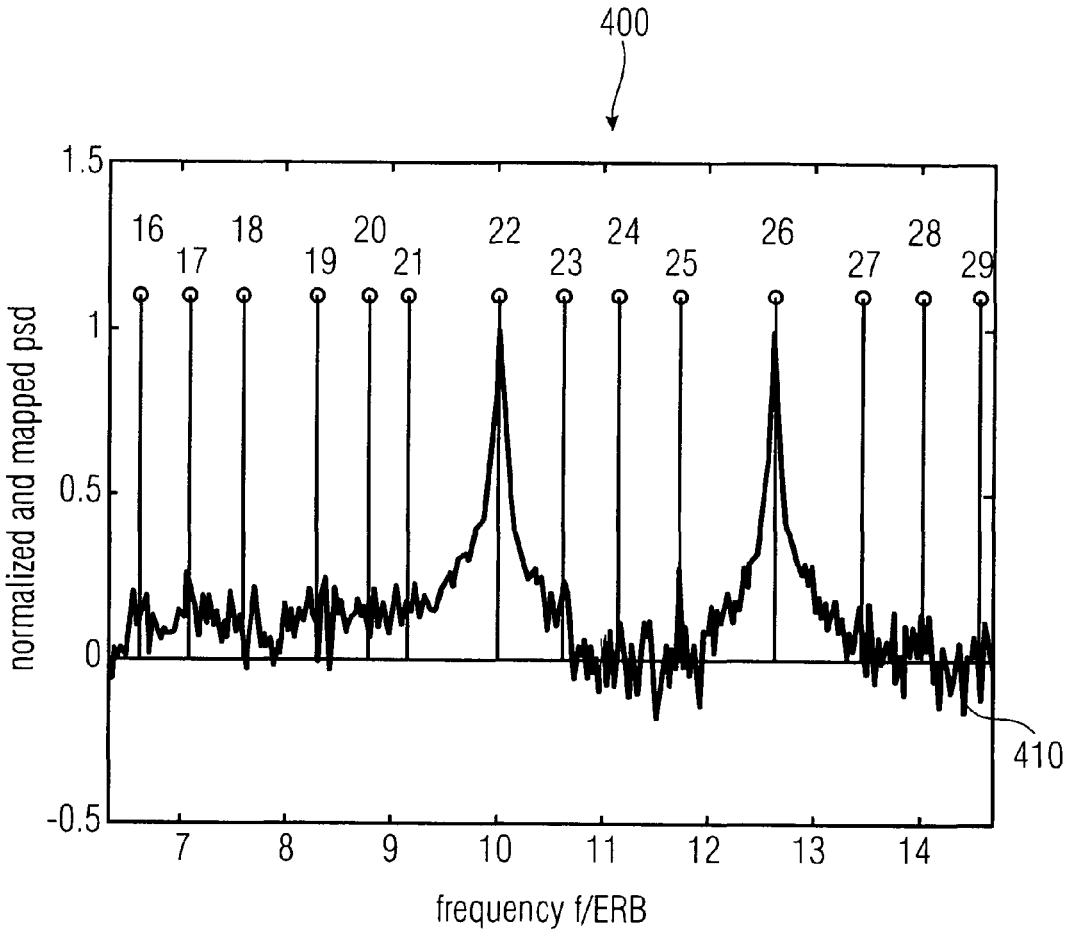
FIG. 4 is a schematic illustration of local center of gravity estimates vs. mapped spectrum (excerpt) of two separate tones.
Figure 5:
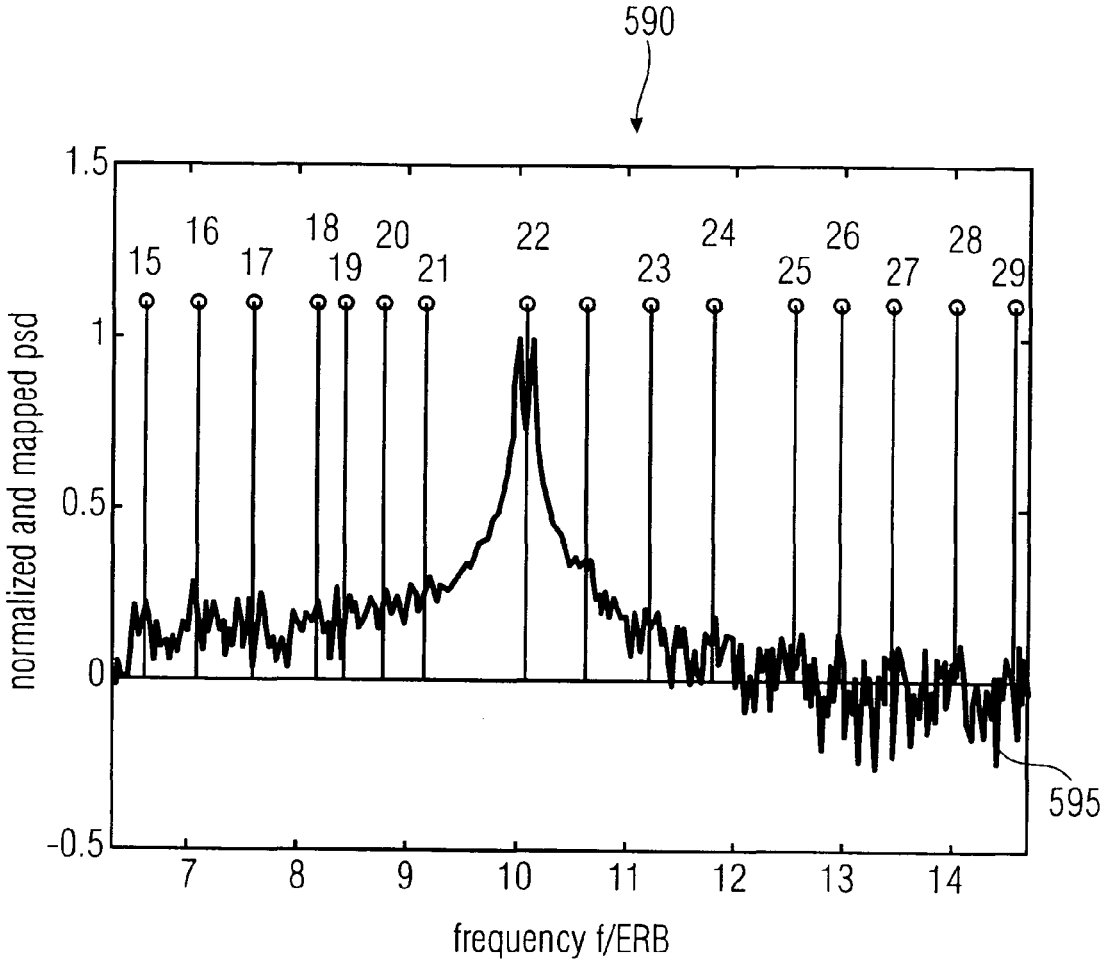
FIG. 5 is a schematic illustration of local center of gravity estimates vs. mapped spectrum (excerpt) of two beating tones.
Figure 6:
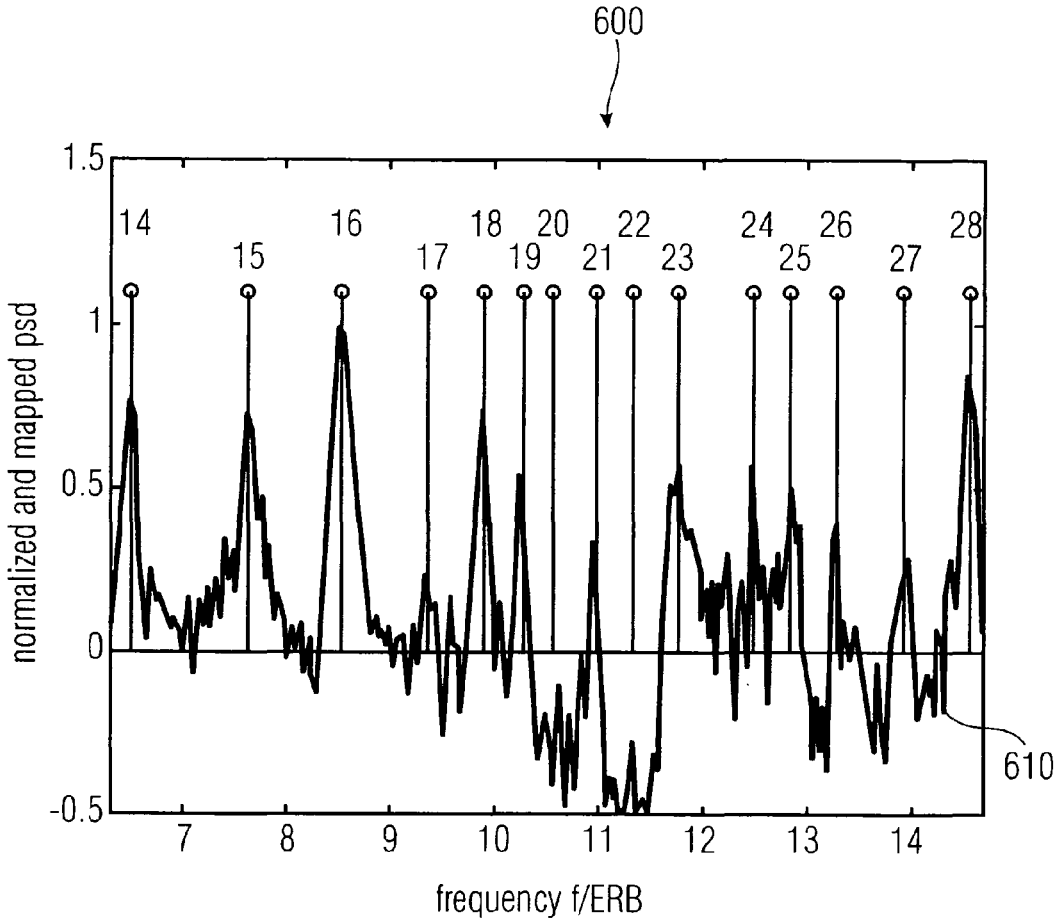
FIG. 6 is a schematic illustration of local center of gravity estimates vs. mapped spectrum (excerpt) of plucked strings.
Figure 7:
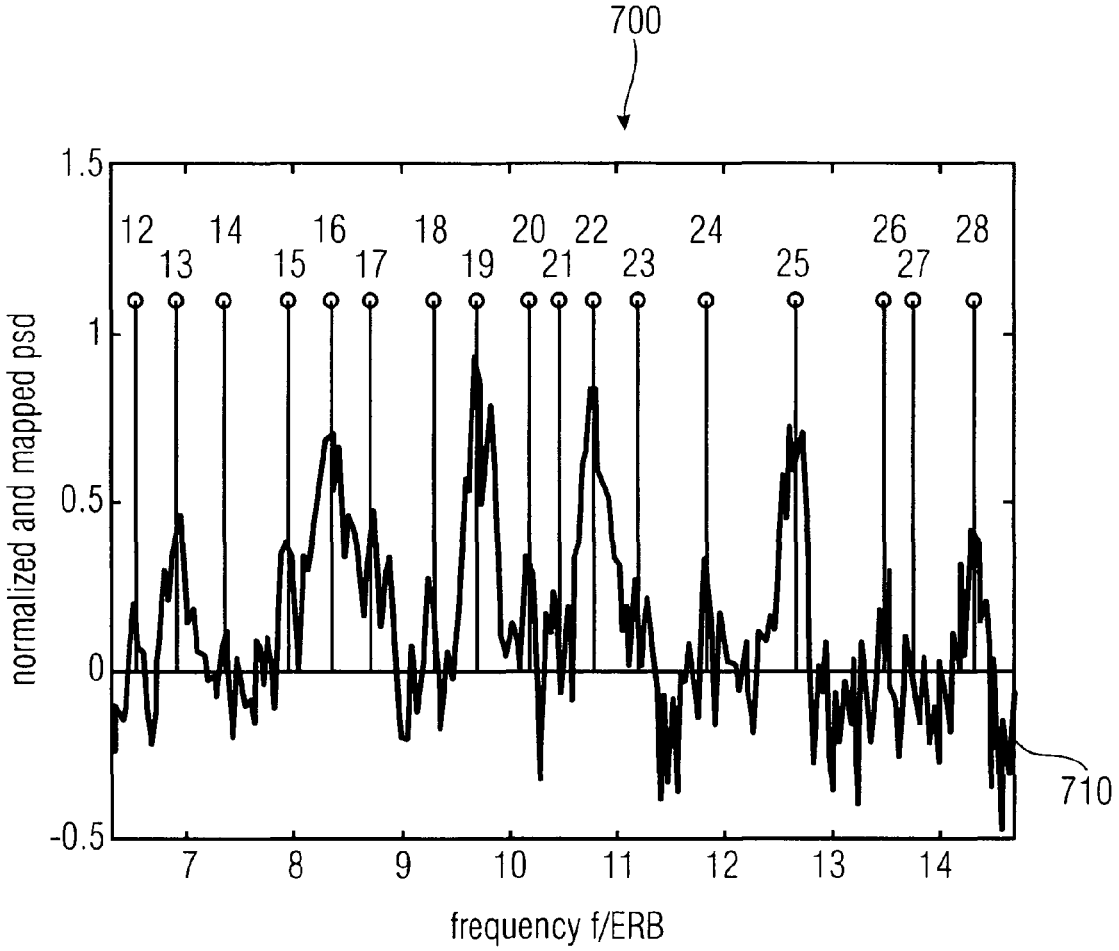
FIG. 7 is a schematic illustration of local center of gravity estimates vs. mapped spectrum (excerpt) of an orchestral music.

FIG. 3*a* shows an example for a diagram 350 of a mapped spectrum 360 and a smoothed spectrum 370 represented by a linear trend.

The preprocessor 310 may be a separate hardware unit, part of a digital signal processor, a micro processor or a computer or realized as a software program.

Figure 15:
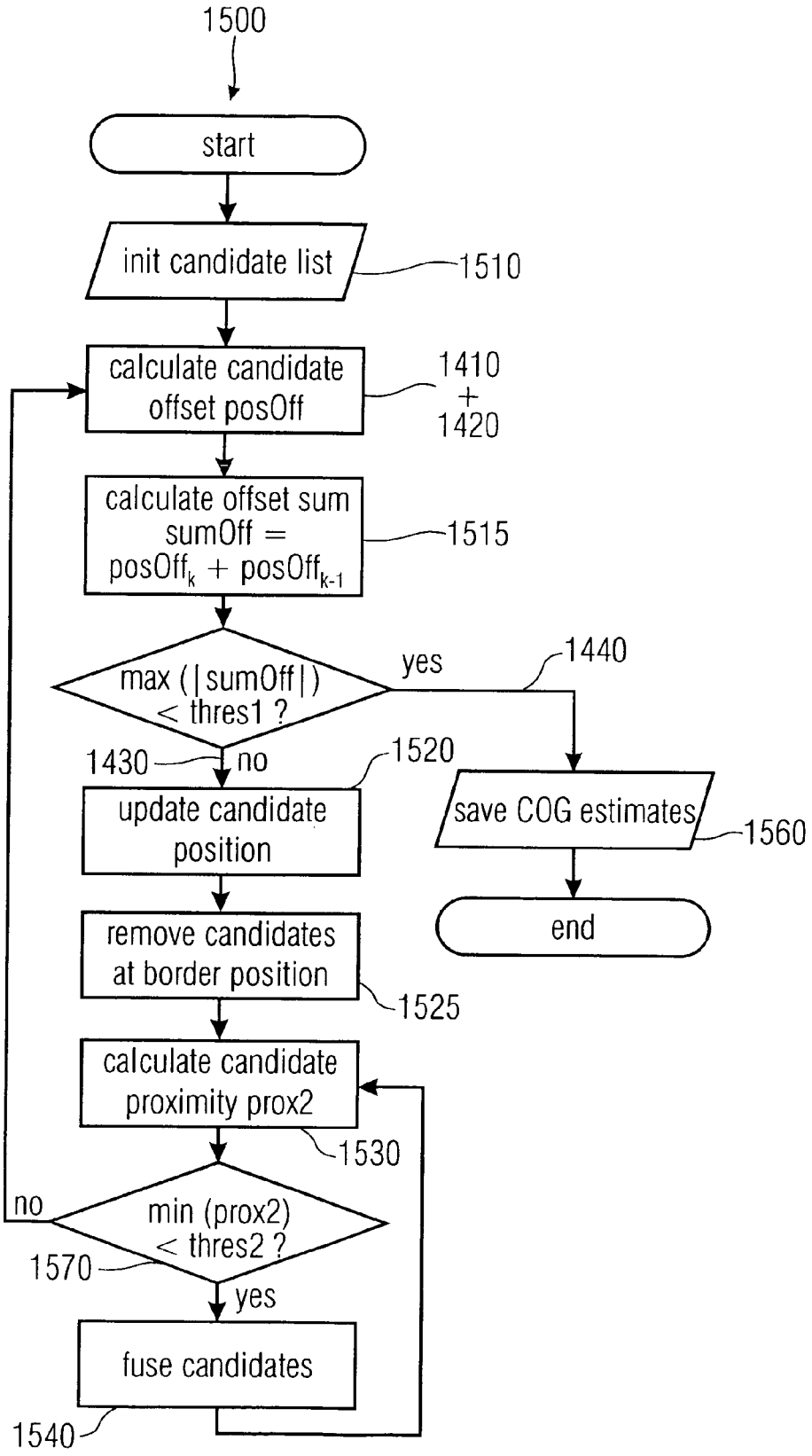
FIG. 15 is a flowchart of a method for determining a plurality of local center-of-gravity frequencies.

FIG. 15 shows a flowchart of a method 1500 for determining a plurality of local center-of-gravity frequencies of a spectrum of an audio signal according to an embodiment of the invention. The method 1500 describes a more detailed example for the iterative center of gravity estimation described above.

For each time block k, a sorted position candidate list c may be initialized 1510 with a uniformly spaced grid of N candidate positions c(n) having a spacing S. The parameter S sets the spectral resolution of the estimates obtained in the course of the iteration process. Phrased differently, the parameter S may determine what is considered to be the local scope of the COG estimation.

$$c(n)=nS$$

$$n\in[1,2\ldots,N] \tag{3}$$

For example, using a time block length of 2^14 samples, the DFT spectrum consists of 2^13+1 samples. Those are mapped to an ERB scale representation also having 2^13+1 samples. Choosing a COG resolution equivalent to 0.5 ERB, this gives S=47 samples at 48 kHz sampling frequency and hence N=174 initial equally spaced candidates. In the iteration, for example, 40-50 final COG positions are estimated. The total number of final COG positions is dependent on the signal characteristics, the weights g(i) and on the COG resolution measured in ERB (also see equations 4). Sensible values for the COG resolution are, for example, in the interval of 0.1-1 ERB.

The iteration process consists of two loops. The first loop calculates 1410 the position offset posOff(n) of the candidate position c(n) from the true local center of gravity by application of a negative-to-positive linear slope function of size 2S, weighted by weights g(i), to each candidate position n on the preprocessed psd estimate of a signal block (see equations 4).

$$posOff(n)=\text{round}\left(\frac{\sum_i (w_n(i)\cdot idxOff(i))}{\sum_i w_n(i)}\right) \tag{4}$$

$$w_n(i)=psd(c(n)+idx(i))\cdot g(i)$$

$$idxOff(i)=i-S+0.5$$

$$idx(i)=\text{round}\ (idxOff(i))$$

$$i\in[0,1,2\ \ldots\ ,2S-1]$$

In other words, the offset determiner 110 may determine the offset frequency, also called position offset, based on a plurality of discrete sample values of the spectrum (the power spectral density values in this example) and a plurality of corresponding values of a weight parameter g(i) and corresponding values of a distance parameter idxOff(i). The values of the distance parameter may be equally spaced from each other on a logarithmic scale, wherein all values of the distance parameter are smaller than a maximum distance value (in this example S). Further, the distance parameter may take positive or negative values, as for example shown by equations 4. The weight parameter may be based on a window function, as for example a rectangle or a window with more or less steep edges. In this way, the influence of large peaks far away from the iteration start frequency (also called candidate in this example), for which the offset frequency is currently determined, is reduced. In other words, the values of the weight parameter may be all the same (for example for a rectangle) or the values of the weight parameter may decrease for increasing absolute values of the corresponding distance parameter (for example, to reduce the influence of peaks with large distance).

Figure 15A:
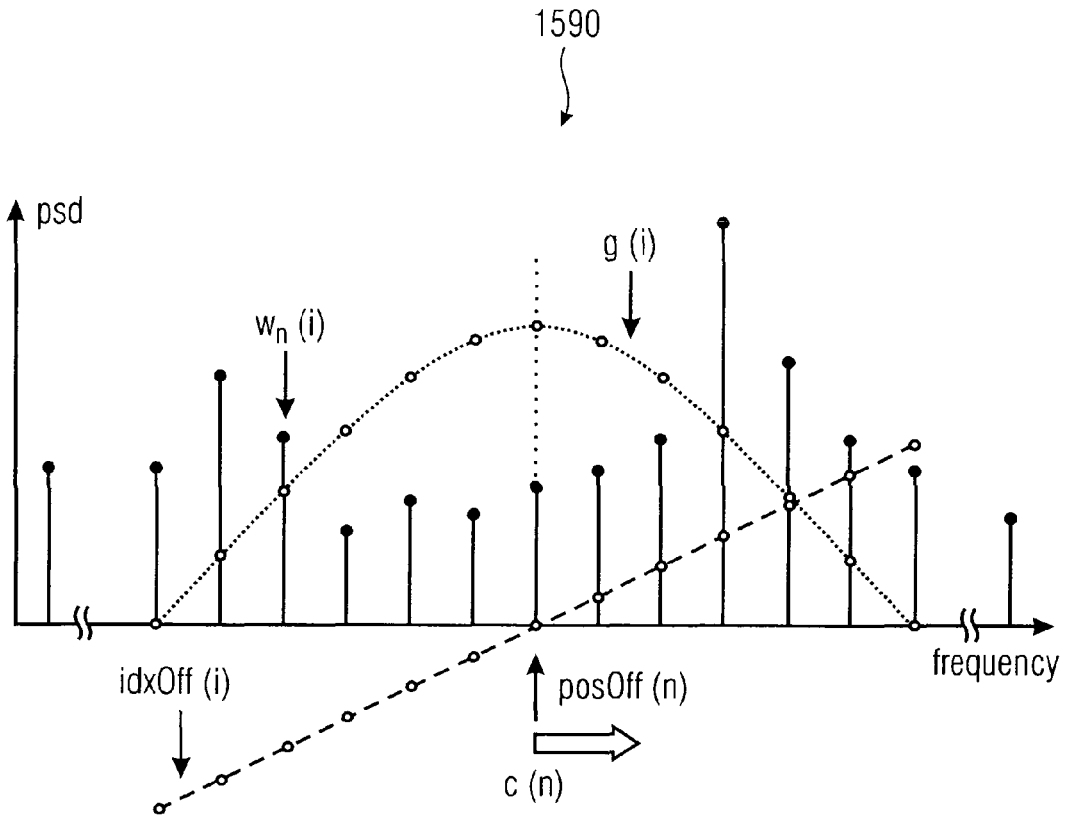
FIG. 15*a* is a schematic illustration of an iterative COG estimation.

In FIG. 15*a*, the candidate position offset posOff(n) procedure is visualized. The stem plots 1590 correspond to the local psd samples $w_n(i)$ centered at the candidate position c(n), the window function is represented by values g(i) and the linear slope function is denoted by idxOff(i).

In a next step (see equation 5), all candidate positions from the list are updated 1420 by their position offset.

$$c(n):=c(n)+\text{posOff}(n) \tag{5}$$

Each candidate position that violates the border limitations (frequencies higher than the maximum frequency of the spectrum and lower than the minimum frequency of the spectrum) is removed 1525 from the list as indicated by (see equations 6) and the number of remaining candidate positions N is decremented by 1.

$$\text{if } (c(n)<S) \vee (c(n)>NS) \rightarrow$$

$$c(x):=c(x+1)\forall x\epsilon[n+1, \ldots, N-1]$$

$$N:=N-1 \tag{6}$$

If the absolute value of the sum of the actual and the previous position offsets of a candidate as defined in (see equation 7a) is smaller than a predefined threshold this candidate position c(n) is not updated in further iterations but still remains in the list and is thus subjected to the subsequent candidate fusion mechanism.

$$\text{sumOff}(n)=\text{posOff}_k(n)+\text{posOff}_{k-1}(n) \tag{7a}$$

If |sumOff(n)| of all candidates is smaller than a predefined threshold (see equation 7b) the first iteration loop is exited 1440 hereby terminating the iteration process. All remaining candidates from the list constitute the final set of COG position estimates. Note that using this type of condition also ends the iteration in case if the position offset toggles back and forth between two values hereby ensuring proper termination.

$$\max(|\text{sumOff}(n)|)<\text{thres1} \tag{7b}$$

Otherwise the next iteration step may be executed with the updated candidate positions 1520.

For example, thres1 may be set equal or smaller than one sample (2 samples, 5 samples or 10 samples).

The second loop iteratively fuses 1540 the closest (according to a certain proximity measure) two position candidates that violate 1570 a predefined proximity restriction due to the position update provided by the first loop, into one single new candidate, thereby accounting for perceptual fusion. The proximity measure prox2 1530 is the spectral distance of the two candidates (see equations 8).

$$\text{prox2}<\text{thres2}$$

$$\text{prox2}=|c(n)-c(n+1)|$$

$$\text{thres2}:=S \tag{8}$$

For example, thres2 may be set to S samples, S/2 samples, 2S samples or another value between 1 sample and 10S samples.

Each newly calculated joint candidate is initialized to occupy the energy weighted mean position of the two former candidates (see equations 9).

$$c(n) := \text{round}\left(\frac{w(n)c(n)+w(n+1)c(n+1)}{w(n)+w(n+1)}\right) \tag{9}$$

$$w(n)=\sum_i w_n(i)=\sum_i (psd(c(n)+idx(i))\cdot g(i))$$

$$c(x) := c(x+1)\ \forall\, x \in [n+1, \ldots, N-1]$$

$$N := N-1$$

Both former candidates are deleted from the list and the new joint candidate is added to the list. Consequently, the number of remaining candidate positions N is decremented by 1. The second loop iteration terminates 1570 if no more candidates violate the proximity restriction. The final set of COG candidates constitutes the estimated local centers of gravity positions.

The estimated center-of-gravity frequencies may be saved 1560, transmitted or provided for further processing.

In order to speed up the iteration process the initialization of each new block can advantageously be done using the COG position estimate of the previous block since it is already a fairly good estimate of the current positions. For example, this applies due to the block overlap in the analysis and the temporal smoothing in the pre-processing hence the appropriate assumption of a limited change rate in temporal evolution of COG positions.

Figure 16:
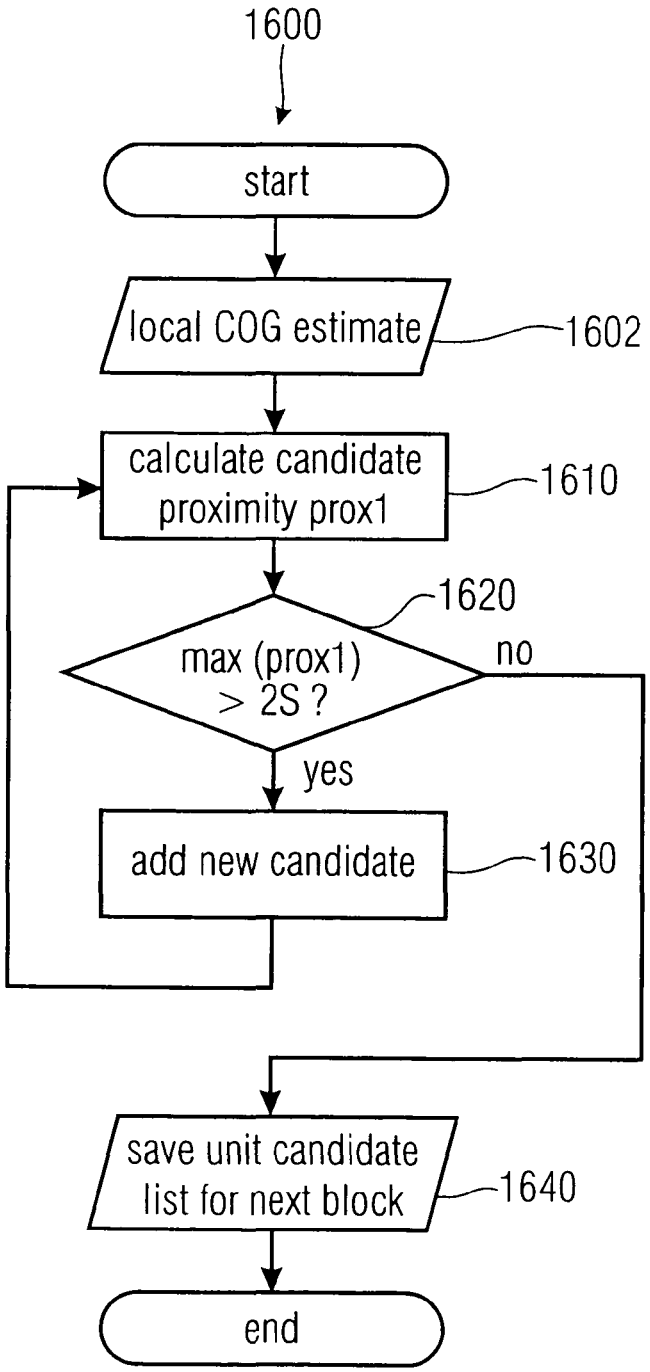
FIG. 16 is a flowchart of a method for adding an iteration start frequency.
Figure 17:
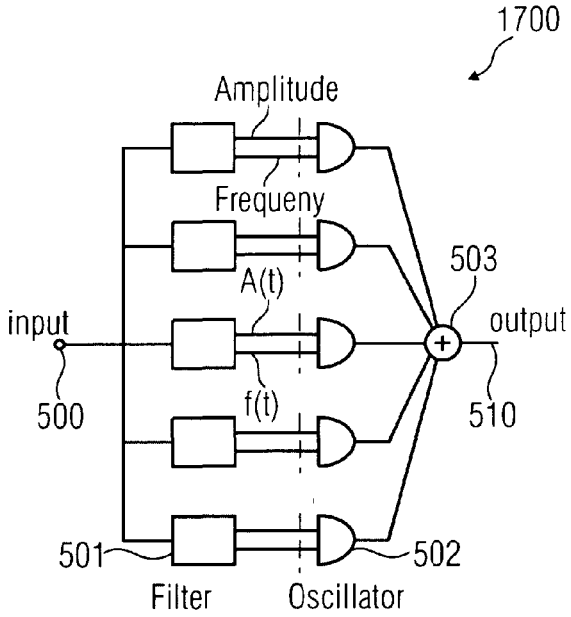
FIG 17 (PRIOR ART)
FIG. 17 is a schematic illustration of a prior art analysis-synthesis-vocoder structure.
Figure 18:
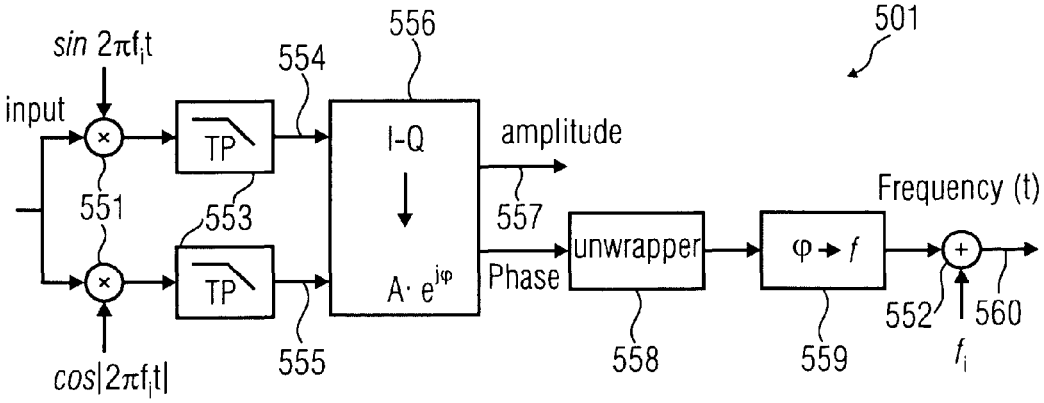
FIG 18 (PRIOR ART)
FIG. 18 is a schematic illustration of a prior art filter implementation of the vocoder structure shown in FIG. 17.

Still, care has to be taken to provide enough initial position estimates to also capture the possible emergence of new COG. Therefore, position candidate gaps in the estimate spanning a distance greater than a predefined value, for example located in an interval S, . . . , 2S, are filled by new COG position candidates (see equations 10) thus ensuring that potential new candidates are within the scope of the position update function. FIG. 16 shows a flow chart of this extension 1600 to the algorithm. The apposition of additional candidates to the list is accomplished with a loop that terminates 1620 if no more gaps larger than 2S are found.

$$\text{if } prox1 > 2S \rightarrow \tag{10}$$

$$prox1 = c(n+1)-c(n)$$

$$c(x+1) := c(x)\ \forall\, x \in [N, N-1, \ldots, n+1]$$

$$c(n+1) := \text{round}\left(\frac{c(n)+c(n+1)}{2}\right)$$

$$N := N+1$$

In other words, for a plurality of local center-of-gravity frequencies or local center of gravity estimates 1602, the frequency distance between adjacent local center-of-gravity frequencies is calculated 1610. If 1620 the frequency distance between two adjacent center-of-gravity frequencies is larger than a maximum frequency distance, a local center-of-gravity frequency is added 1630 to the plurality of local center-of-gravity frequencies. After filling all gaps larger than the maximum frequency distance, the plurality of local center-of-gravity frequencies may be saved 1640 for the next time block.

FIGS. 4, 5, 6, and 7 visualize results obtained by the proposed iterative local COG estimation algorithm described before that has been applied to different test items. The test items are two separate pure tones 400, two tones that beat with each other 590, plucked strings 600 ('MPEG Test Set—sm03') and orchestral music ('Vivaldi—Four Seasons, Spring, Allegro') 700. In these figures, the perceptually mapped, smoothed and globally detrended (normalized) spectrum 410, 595, 610, 710 is displayed along with the COG estimates (reference numerals 12-26). The COG estimates are numbered in ascending order. While e.g. the estimates no. 22, no. 26 of FIG. 4 and estimates no. 18 and no. 19 of FIG. 6 correspond to sinusoidal signal components, estimate no. 22 of FIG. 5, estimates no. 23 and no. 25 of FIG. 6 and most estimates of FIG. 7 capture spectrally broadened or beating components, which are nevertheless detected and segmented well, thus grouping them into perceptual units.

Figure 8:
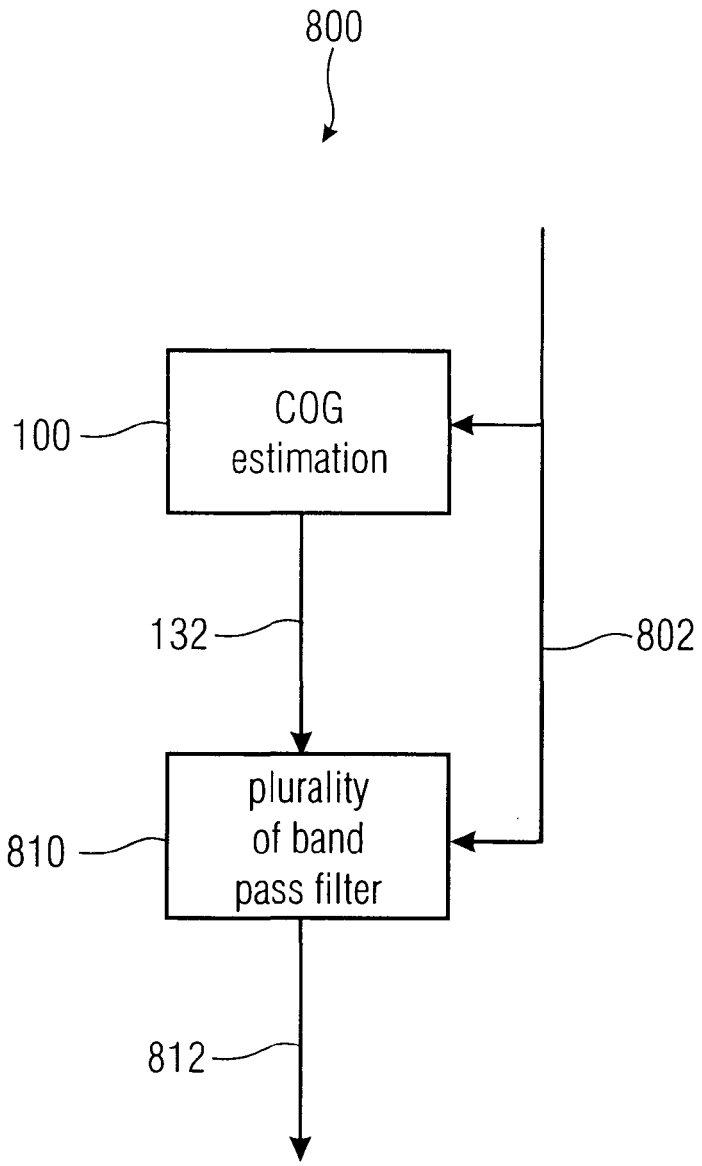
FIG. 8 is a block diagram of a signal adaptive filter bank.

FIG. 8 shows a block diagram of a signal adaptive filter bank 800 according to an embodiment of the invention. The signal adaptive filter bank 800 comprises an apparatus 100 for determining a plurality of local center-of-gravity frequencies 132 of a spectrum of an audio signal 802 and a plurality of bandpass filters 810. The plurality of bandpass filters 810 is configured to filter the audio signal 802 and to provide the filtered audio signal 812 for transmission, storage or further processing. For this, a center frequency and a bandwidth of each bandpass filter of the plurality of bandpass filters 810 is based on the plurality of local center-of-gravity frequencies 132.

For example, each bandpass filter of the plurality of bandpass filters 810 corresponds to a local center-of-gravity frequency, wherein the center frequency and the bandwidth of the bandpass filter depends on the corresponding local center-of-gravity frequency and the adjacent local center-of-gravity frequencies of the corresponding local center-of-gravity frequency.

The bandwidth of the plurality of bandpass filters 810 may be determined, so that the whole spectrum is covered without holes.

The filters may be designed on a logarithmic frequency scale according to the original COG estimates obtained on a logarithmic scale and the resulting spectral weights may be mapped to the linear domain or, alternatively, in other embodiments the filters may be designed in the linear domain according to the re-mapped COG positions.

In other words, for the latter embodiment, after having determined the COG estimates, for example, in the ERB adapted domain the COG positions are mapped back into the linear domain by solving equation 2 for f and subsequently, in linear domain, a set of N bandpass filters is calculated in the form of spectral weights, which are to be applied directly to the original DFT spectrum of the broadband signal.

For the first embodiment, the COG positions are further processed in the ERB domain. A set of N bandpass filters is calculated in the form of spectral weighting functions weights of length M according to equations (10a). In other words, a set of bandpass filters may be calculated in the form of spectral weights, which are, after a mapping to linear domain, to be applied to the original DFT spectrum of the broadband signal.

For example, the bandpass filters are designed to have a predefined roll-off of length 2 rollOff with sine-squared characteristic. To achieve the desired alignment with the estimated COG positions, the design procedure described in the following may be applied.

Firstly, the middle positions between adjacent COG position estimates are calculated where $m_L(n)$ denotes the lower midpoint and $m_U(n)$ the upper midpoint of a COG position c (n) relative to its neighbors. Then, at these transition points, the roll-off parts of the spectral weights are centered such that the roll-off parts_of neighboring filters sum up to one. The middle section of the bandpass weighting function is chosen to be flat-top equal to one, the remaining sample points are set to zero The filters for n=0 and n=N have only one roll-off part and are configured to be lowpass or highpass, respectively.

$$\text{weights}_n(m) = \begin{cases} \sin^2(k_L(m)) & m_L(n) - rollOff < m < m_L(n) + rollOff \\ 1 & m_L(n) + rollOff \le m \le m_U(n) - rollOff \\ \sin^2(k_U(m)) & m_U(n) - rollOff < m < m_U(n) + rollOff \\ 0 & \text{otherwise} \end{cases} \tag{10a}$$

$$m \in [0, 1 \ldots, M-1]$$

$$m_L(n) = \text{round}\left(\frac{c(n) - c(n-1)}{2}\right)$$

$$m_U(n) = \text{round}\left(\frac{c(n+1) - c(n)}{2}\right)$$

$$k_L(m) = (m - m_L(n) + rollOff)\frac{\pi}{4 \cdot rollOff}$$

$$k_U(m) = (m - m_U(n) - rollOff)\frac{\pi}{4 \cdot rollOff} + \frac{\pi}{2}$$

In designing the roll-off characteristic, a trade-off has to be made with respect to spectral selectivity on the one hand and temporal resolution on the other hand. Also, allowing multiple filters to spectrally overlap may add an additional degree of freedom to the design restrictions. The trade-off may be chosen in a signal adaptive fashion for e.g. improving on the reproduction of transients.

Lastly, the COG positions and the spectral weighting functions are mapped back to linear domain by solving equation (2) for f obtaining equation (10b). Finally, the spectral weights on a linear scale are yielded, which are to be applied to the DFT spectrum of the broadband signal.

$$f(ERB) = \frac{1}{0.00437}\left(10^{\frac{ERB}{21.4}} - 1\right) \tag{10b}$$

By using a logarithmic spectrum and an initialization with equally spaced iteration start frequencies the tendency for a perceptual segmentation (small bandwidths for low frequencies and large bandwidths for high frequencies) may be achieved, although in some regions of the spectrum the bandwidth of filters for low frequencies might be larger than the bandwidth of filters for higher frequencies, since the positions of the local center-of-gravity frequencies depends on the audio signal.

For example, the edges of the bandpass filters may be located in the middle of every two adjacent center-of-gravity frequencies on a logarithmic or a linear scale. Alternatively, also an overlap of several bandpass filters may be possible.

Some embodiments of the invention relate to an application of the described concept for filterbanks or phase vocoders. The described concept may be used for music manipulation, for example, for changing pitches of only one or a predefined number of channels.

Figure 9:
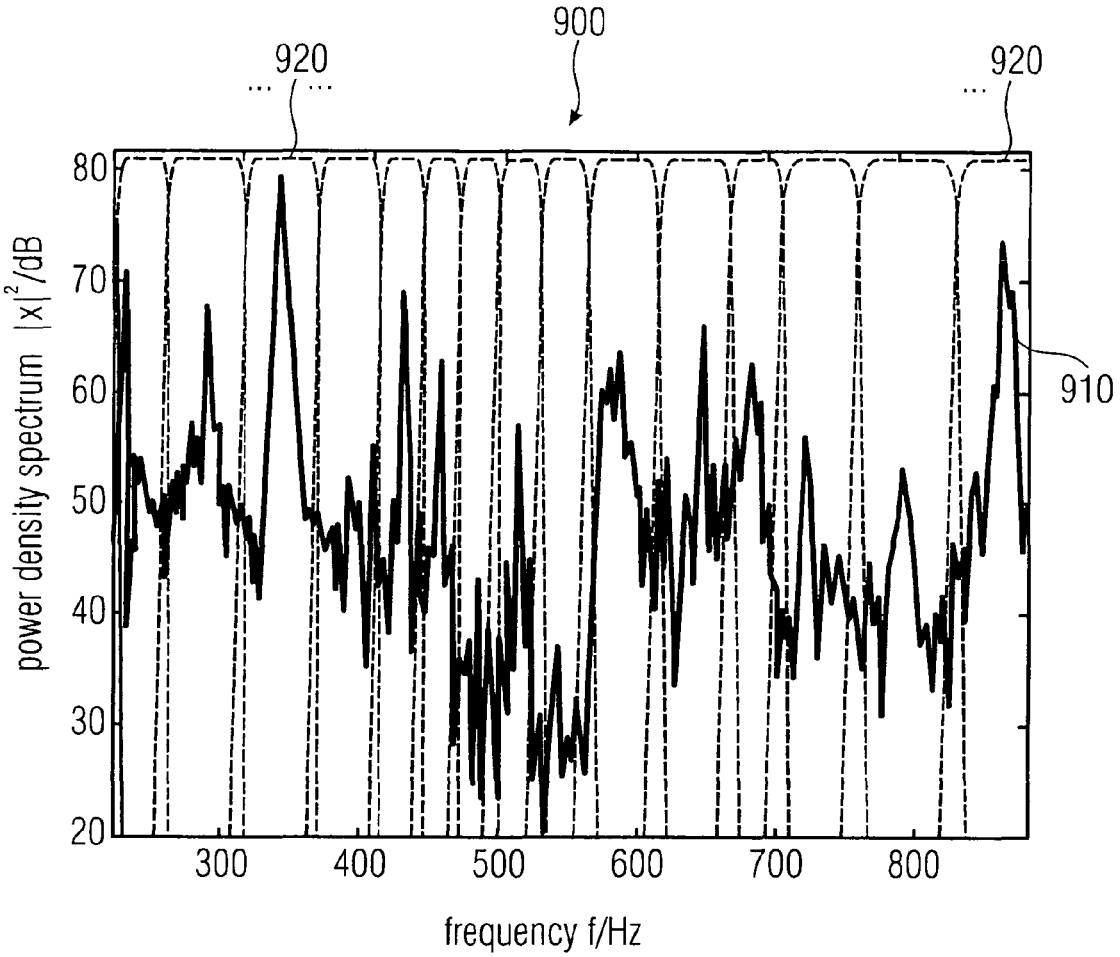
FIG. 9 is a schematic illustration of a bandpass segmentation aligned with local center of gravities vs. power spectrum (excerpt) of plucked strings.
Figure 10:
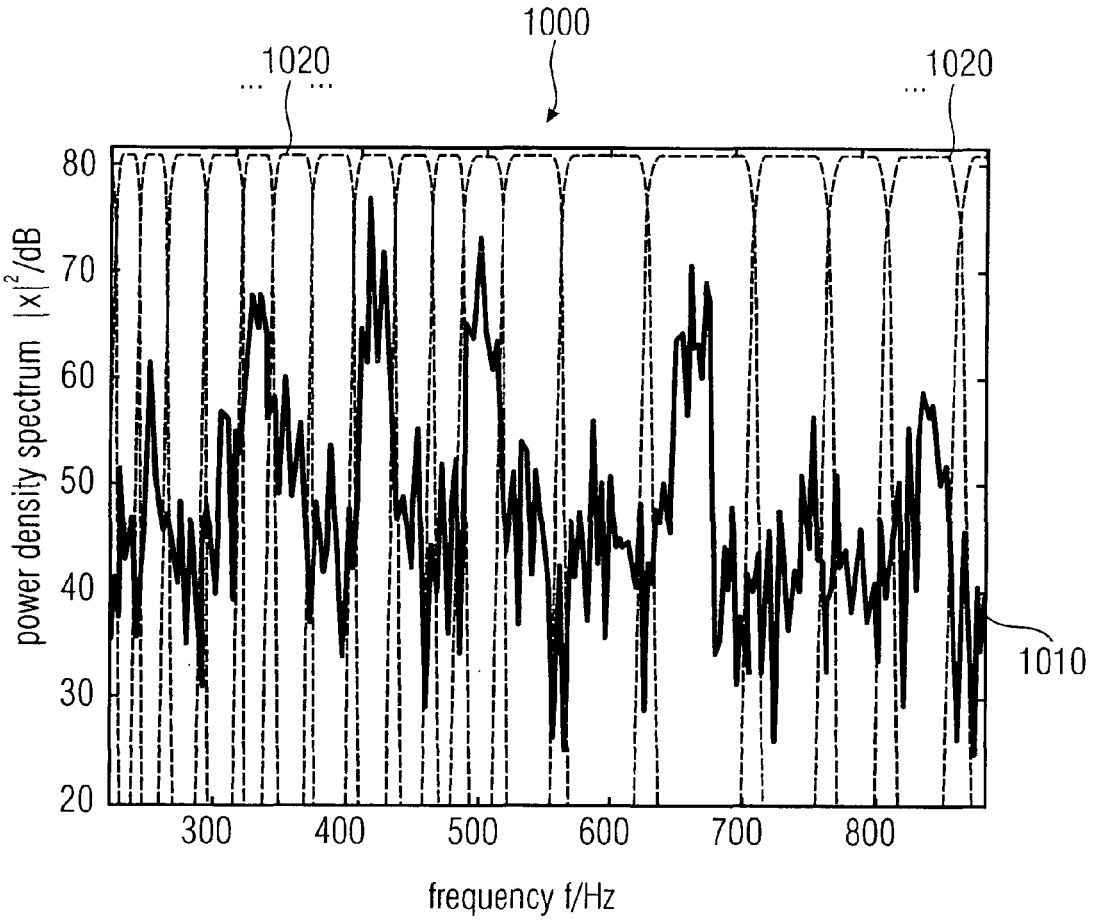
FIG. 10 is a schematic illustration of a bandpass segmentation aligned with local center of gravity vs. power spectrum (excerpt) of an orchestral music.

In FIGS. 9 and 10, the original—non pre-processed—psd 910, 1010 of the signal block 900, 1000 is depicted and a set of bandpass filters 920, 1020 is sketched, that has been designed as outlined before. It is clearly visible, that each filter is aligned with a COG estimate and pairwise smoothly overlaps with its adjacent subband filters. FIG. 9 corresponds to FIG. 6 and FIG. 10 corresponds to FIG. 7.

Figure 11:
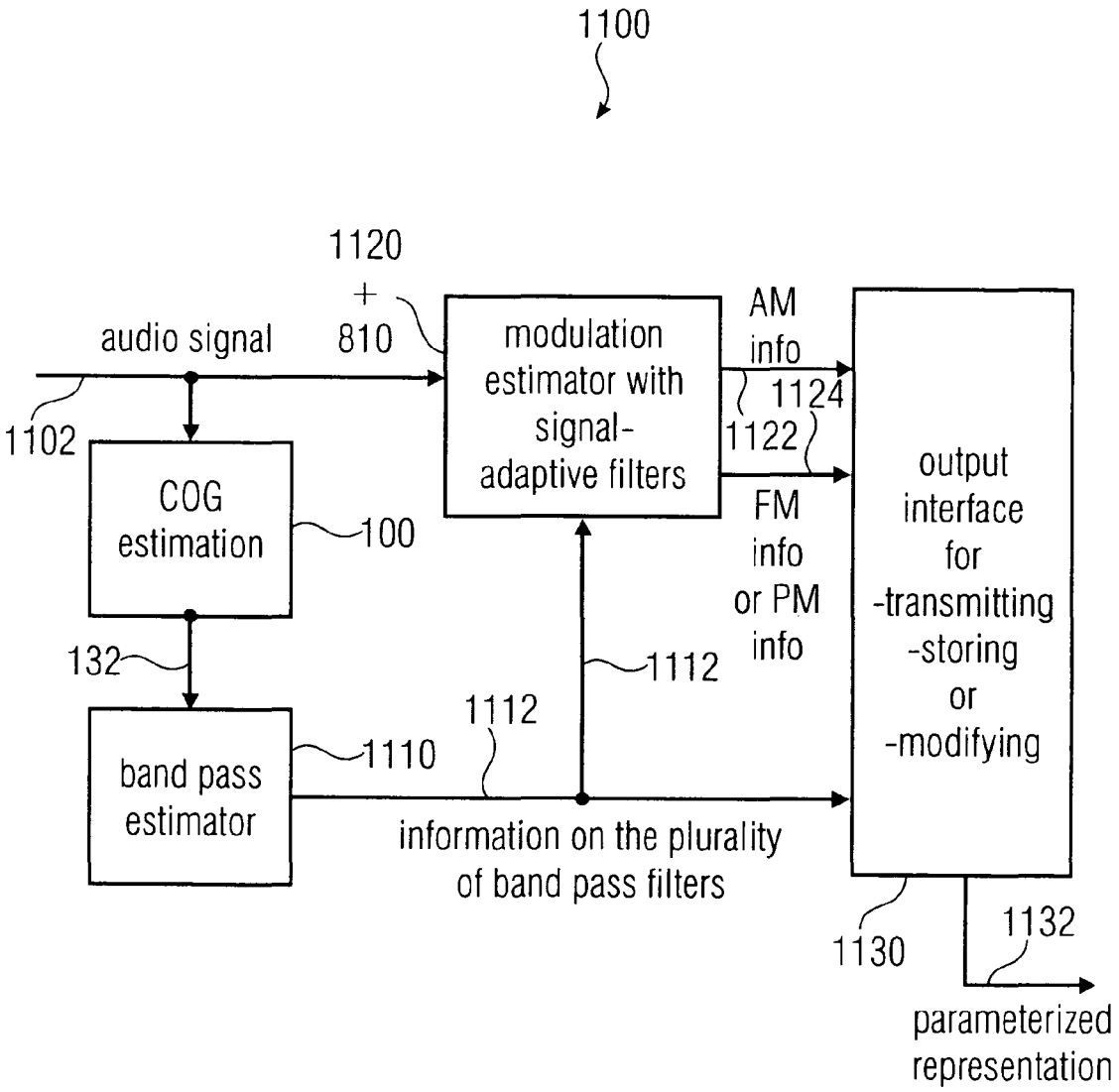
FIG. 11 is a block diagram of an apparatus for converting an audio signal into a parameterized representation.

FIG. 11 shows a block diagram of an apparatus 1100 for converting an audio signal 1102 into a parameterized representation 1132 according to an embodiment of the invention. The apparatus 1100 comprises an apparatus 100 for determining a plurality of local center-of-gravity frequencies 132 of a spectrum of the audio signal 1102, a bandpass estimator 1110, a modulation estimator 1120 and an output interface 1130. The apparatus 100 for determining the plurality of local center-of-gravity frequencies 132 is also called signal analyzer and the modulation estimator 1120 comprises a plurality of bandpass filters 810.

The signal analyzer 100 analyses a portion of the audio signal 1102 to obtain an analysis result 132 in terms of the local center-of-gravity frequencies 132. The analysis result 132 is input into a band pass estimator 1110 for estimating information 1112 on a plurality of band pass filters 810 for the audio signal portion based on the signal analysis result 132. Thus, the information 1112 on the plurality of bandpass filters 810 is calculated in a signal-adaptive manner.

Specifically, the information 1112 on the plurality of bandpass filters 810 comprises information on a filter shape. The filter shape can include a bandwidth of a bandpass filter and/or a center frequency of the bandpass filter for the portion of the audio signal, and/or a spectral form of a magnitude transfer function in a parametric form or a non-parametric form. Importantly, the bandwidth of a bandpass filter is not constant over the whole frequency range, but may depend on the center frequency of the bandpass filter. For example, the dependency is so that the bandwidth increases to higher center frequencies and decreases to lower center frequencies.

The signal analyzer 100 performs a spectral analysis of a signal portion of the audio signal and, particularly, may analyze the power distribution in the spectrum to find regions having a power concentration, since such regions are determined by the human ear as well when receiving and further processing sound.

The inventive apparatus 1100 additionally comprises a modulation estimator 1120 for estimating an amplitude modulation 1122 or a frequency modulation 1124 for each band of the plurality of bandpass filters 810 for the portion of the audio signal. To this end, the modulation estimator 1120 uses the information 1112 on the plurality of bandpass filters 810 as will be discussed later on.

The inventive apparatus of FIG. 11 additionally comprises an output interface 1130 for transmitting, storing or modifying the information on the amplitude modulation 1112, the information of the frequency modulation 1124 or the information on the plurality of bandpass filters 810, which may comprise filter shape information such as the values of the center frequencies of the bandpass filters for this specific portion/block of the audio signal or other information as discussed above. The output is a parameterized representation 1132.

Figure 12:
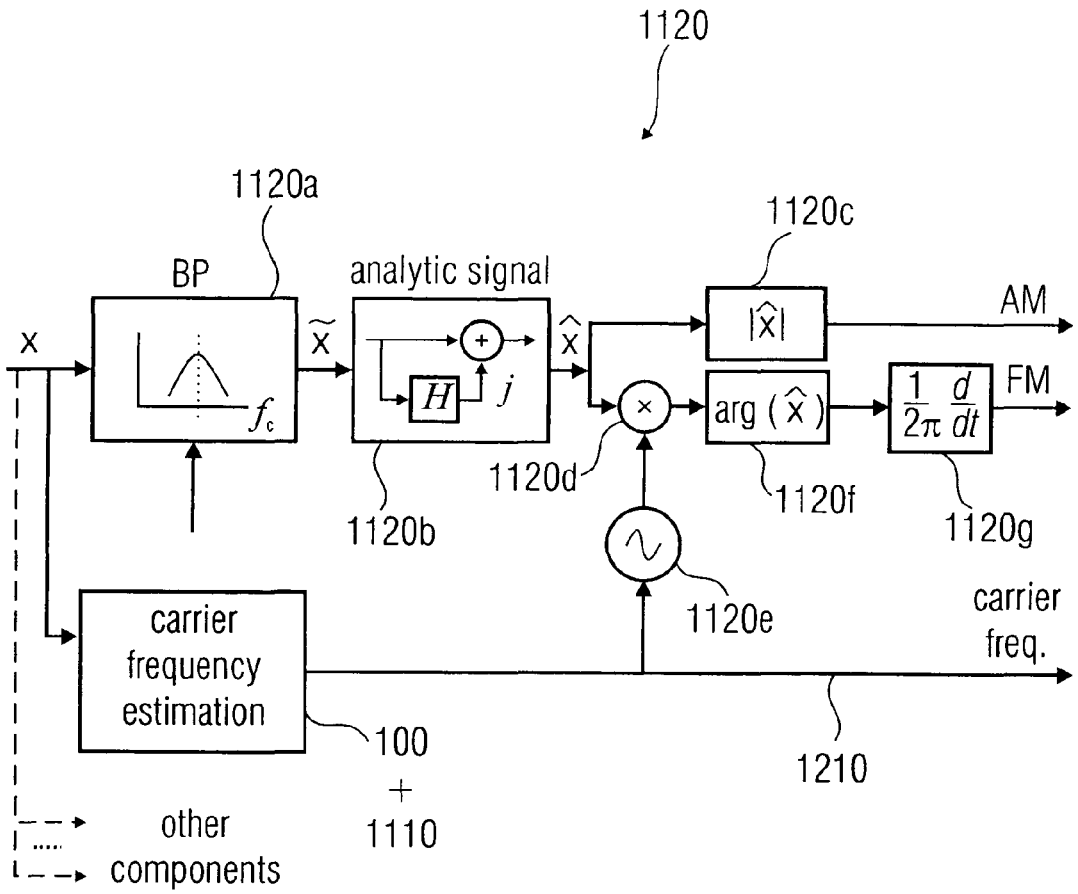
FIG. 12 is a block diagram of an apparatus for converting an audio signal into a parameterized representation.
Figure 12A:
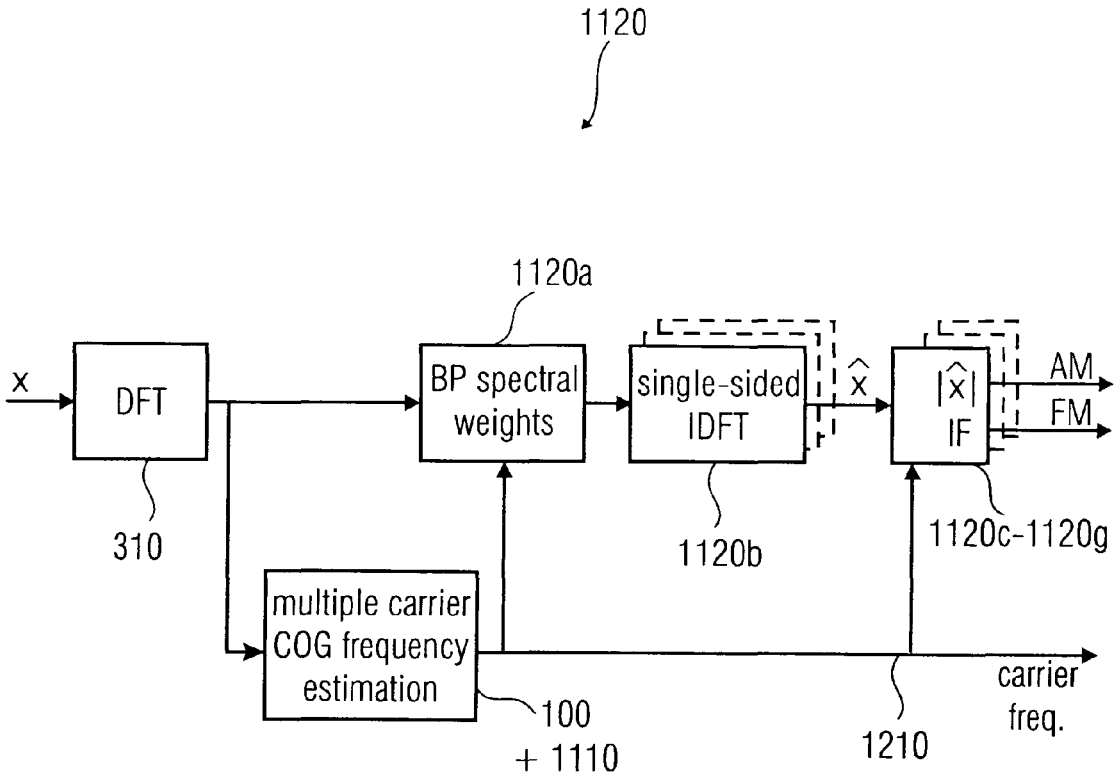
FIG. 12*a* is a block diagram of an apparatus for converting an audio signal into a parameterized representation.

FIGS. 12 and 12*a* illustrate two embodiments of the modulation estimator 1120 and the signal analyzer 100 and the bandpass estimator 1110 combined into a single unit, which is called "carrier frequency estimation". The modulation estimator 1120 comprises a bandpass filter 1120*a*, which provides a bandpass signal. This is input into an analytic signal converter 1120*b*. The output of block 1120*b* is useful for calculating AM information and FM information. For calculating the AM information, the magnitude of the analytical signal is calculated by block 1120*c*. The output of the analytical signal block 1120*b* is input into a multiplier 1120*d*, which receives, at its other input, an oscillator signal from an oscillator 1120*e*, which is controlled by the actual carrier frequency $f_c$ 1210 of the band pass 1120*a*. Then, the phase of the multiplier output is determined in block 1120*f*. The instantaneous phase is differentiated at block 1120*g* in order to finally obtain the FM information. In addition, FIG. 12*a* shows a preprocessor 310 generating a DFT spectrum of the audio signal.

The multiband modulation decomposition dissects the audio signal into a signal adaptive set of (analytic) bandpass signals, each of which is further divided into a sinusoidal carrier and its amplitude modulation (AM) and frequency modulation (FM). The set of bandpass filters is computed such that on the one hand the fullband spectrum is covered seamlessly and on the other hand the filters are aligned with local COGs each. Additionally, the human auditory perception is accounted for by choosing the bandwidth of the filters to match a perceptual scale e.g. the ERB scale (see "B. C. J. Moore and B. R. Glasberg, "A revision of Zwicker's loudness model," Acta Acustica, vol. 82, pp. 335-345, 1996").

The local COG corresponds to the mean frequency that is perceived by a listener due to the spectral contributions in that frequency region. Moreover, the bands centered at local COG positions correspond to regions of influence based phase locking of classic phase vocoders (see "J. Laroche and M. Dolson, "Improved phase vocoder timescale modification of audio", IEEE Transactions on Speech and Audio Processing, vol. 7, no. 3, pp. 323-332, 1999", "Ch. Duxbury, M. Davies, and M. Sandler, "Improved timescaling of musical audio using phase locking at transients," in 112th AES Convention, 2002", "A. Röbel, "A new approach to transient processing in the phase vocoder," Proc. of the Int. Conf. on Digital Audio Effects (DAFx), pp. 344-349, 2003", "A. Röbel, "Transient detection and preservation in the phase vocoder", Int. Computer Music Conference (ICMC'03), pp. 247-250, 2003"). The bandpass signal envelope representation and the traditional region of influence phase locking both preserve the temporal envelope of a bandpass signal: either intrinsically or, in the latter case, by ensuring local spectral phase coherence during synthesis. With respect to a sinusoidal carrier of a frequency corresponding to the estimated local COG, both AM and FM are captured in the amplitude envelope and the heterodyned phase of the analytical bandpass signals, respectively. A dedicated synthesis method renders the output signal from the carrier frequencies, AM and FM.

A block diagram of the signal decomposition into carrier signals and their associated modulation components is depicted in FIG. 12. In the picture, the schematic signal flow for the extraction of one component is shown. All other components are obtained in a similar fashion. Practically, the extraction is carried out jointly for all components on a block-by-block basis using e.g. a block size of $N=2^{14}$ at 48 kHz sampling frequency and 75% analysis overlap—roughly corresponding to a time interval of 340 ms and a stride of 85 ms—by application of a discrete Fourier transform (DFT) on each windowed signal block. The window may be a 'flat top' window according to Equation (1). This may ensure that the centered N/2 samples that are passed on for the subsequent modulation synthesis are unaffected by the slopes of the analysis window. A higher degree of overlap may be used for improved accuracy at the cost of increased computational complexity.

$$\text{window}(i)_{analysis} = \begin{cases} \sin^2\left(\frac{2i\pi}{N}\right) & 0 < i < \frac{N}{4} \\ 1 & \frac{N}{4} \le i < \frac{3N}{4} \\ \sin^2\left(\frac{2i\pi}{N}\right) & \frac{3N}{4} \le i < N \end{cases} \quad (1)$$

Given the spectral representation, next a set of signal adaptive spectral weighting functions (having bandpass characteristic) that is aligned with local COG positions may be calculated. After application of the bandpass weighting to the spectrum, the signal is transformed to the time domain and the analytic signal is derived by Hilbert transform. These two processing steps can be efficiently combined by calculation of a single-sided IDFT on each bandpass signal. Subsequently, each analytic signal is heterodyned by its estimated carrier frequency. Finally, the signal is further decomposed into its amplitude envelope and its instantaneous frequency (IF) track, obtained by computing the phase derivative, yielding the desired AM and FM signal (see also "S. Disch and B. Edler, "An amplitude- and frequency modulation vocoder for audio signal processing," Proc. of the Int. Conf. on Digital Audio Effects (DAFx), 2008").

Figure 13A:
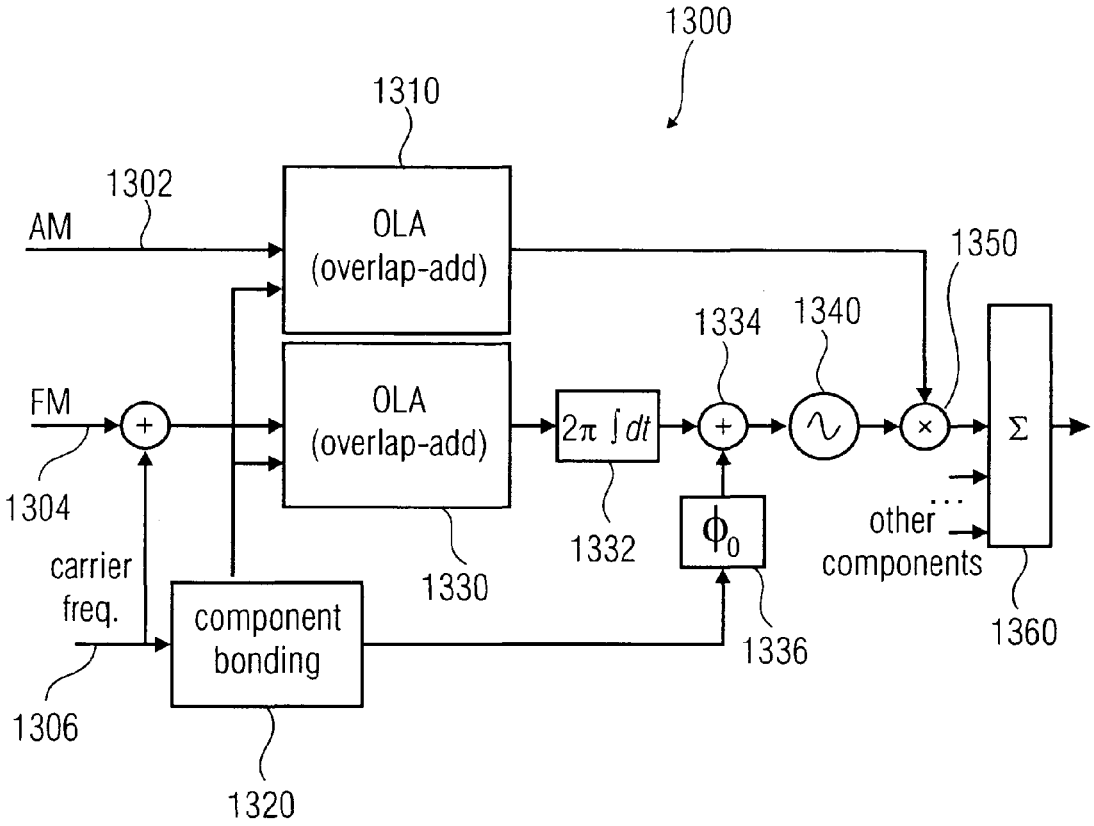
FIG. 13*a* is a block diagram of a synthesis module.

Fittingly, FIG. 13*a* shows a block diagram of an apparatus 1300 for synthesizing a parameterized representation of an audio signal. For example, an advantageous implementation is based on an overlap-add operation (OLA) in the modulation domain, i.e., in the domain before generating the time domain band pass signal. The input signal which may be a bitstream, but which may also be a direct connection to an analyzer or modifier as well, is separated into the AM component 1302, the FM component 1304 and the carrier frequency component 1306. The AM synthesizer comprises an overlap-adder 1310 and, additionally, a component bonding controller 1320 which, not only comprises block 1310 but also block 1330, which is an overlap adder within the FM synthesizer. The FM synthesizer additionally comprises a frequency overlap-adder 1330, a phase integrator 1332, a phase combiner 1334 which, again, may be implemented as a regular adder and a phase shifter 1336 which is controllable by the component bonding controller 1320 in order to regenerate a constant phase from block to block so that the phase of a signal from a preceding block is continuous with the phase of an actual block. Therefore, one can say that the phase addition in elements 1334, 1336 corresponds to a regeneration of a constant that was lost during the differentiation in block 1120*g* in FIG. 12 on the analyzer side. From an information-loss perspective in the perceptual domain, it is to be noted that this is the only information loss, i.e., the loss of a constant portion by the differentiation device 1120*g* in FIG. 12. This loss can be recreated by adding a constant phase determined by the component bonding device 1320.

Overlap-add (OLA) is applied in the parameter domain rather than on the readily synthesized signal in order to avoid beating effects between adjacent time blocks. The OLA is controlled by a component bonding mechanism, that, steered by spectral vicinity (measured on an ERB scale), performs a pair-wise match of components of the actual block to their predecessors in the previous block. Additionally, the bonding aligns the absolute component phases of the actual block to the ones of the previous block.

In detail, firstly the FM signal is added to the carrier frequency and the result is passed on to the OLA stage, the output of which is integrated subsequently. A sinusoidal oscillator 1340 is fed by the resulting phase signal. The AM signal is processed by a second OLA stage. Finally, the output of the oscillator is modulated 1350 in its amplitude by the resulting AM signal to obtain the additive contribution of the component to the output signal 1360.

It should be emphasized that an appropriate spectral segmentation of the signal within the modulation analysis is of paramount importance for a convincing result of any further modulation parameter processing. Therefore, herein, a novel suitable segmentation algorithm is presented.

Figure 13B:
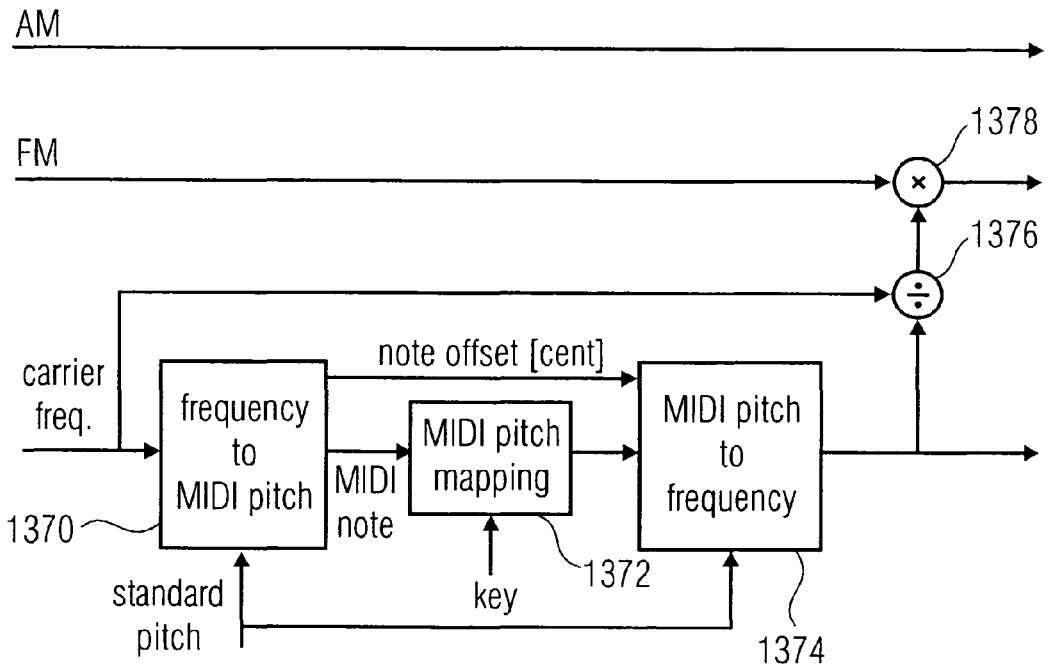
FIG. 13*b* is a schematic illustration of an application for polyphonic key mode changes.

Fittingly, FIG. 13*b* shows an application of the described concept 1300 for polyphonic key mode changes.

Transposing of an audio signal while maintaining original playback speed is a challenging task. Using the proposed system, this is achieved straightforward by multiplication of all carrier components with a constant factor. Since the temporal structure of the input signal is solely captured by the AM signals it is unaffected by the stretching of the carrier's spectral spacing.

An even more demanding effect can be obtained by selective processing: the key mode of a piece of music can be changed from e.g. minor to major or vice versa. Therefore, only a subset of carriers corresponding to certain predefined frequency intervals is mapped to suitable new values. To achieve this, the carrier frequencies are quantized 1370 to MIDI pitches which are subsequently mapped 1372 onto appropriate new MIDI pitches (using a-priori knowledge of mode and key of the music item to be processed). The processing is depicted in FIG. 13*b*.

Figure 13C:
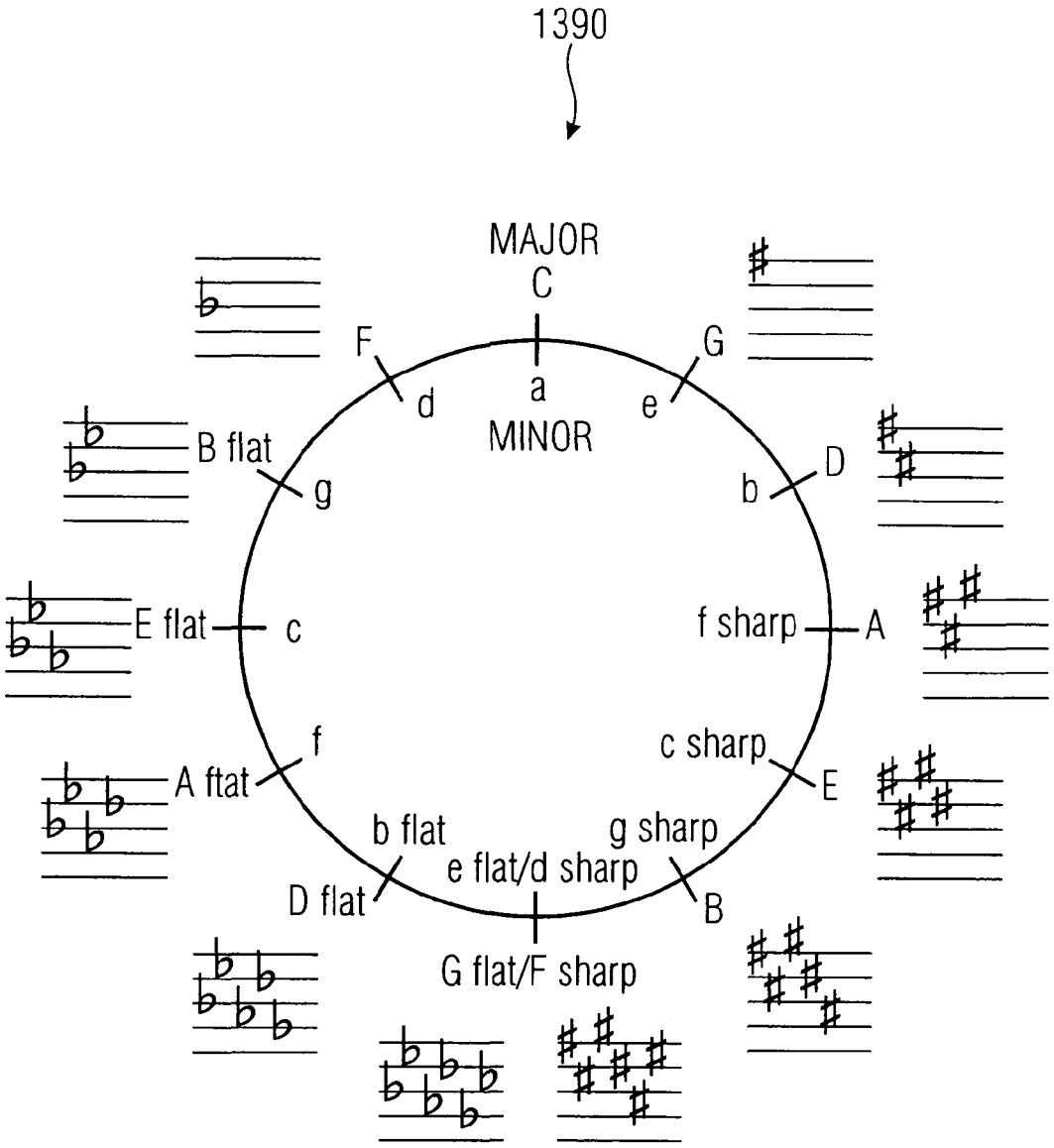
FIG. 13*c* is a schematic illustration of a circle of fifth.

For the case of a conversion between major mode and natural minor mode, the MIDI pitches to be mapped can be derived from the circle of fifth 1390 as depicted in FIG. 13*c*. Major to minor conversion is obtained by a leap of three steps counterclockwise, minor to major change by three steps clockwise. Lastly, the mapped MIDI notes are converted back 1374 in order to obtain 1376 the modified carrier frequencies that are used for synthesis 1378. A dedicated MIDI note onset/offset detection is not necessitated since the temporal characteristics are predominantly represented by the unmodified AM and thus preserved. Arbitrary mapping tables can be defined enabling for conversion to and from other minor flavours (e.g. harmonic minor).

Figure 14:
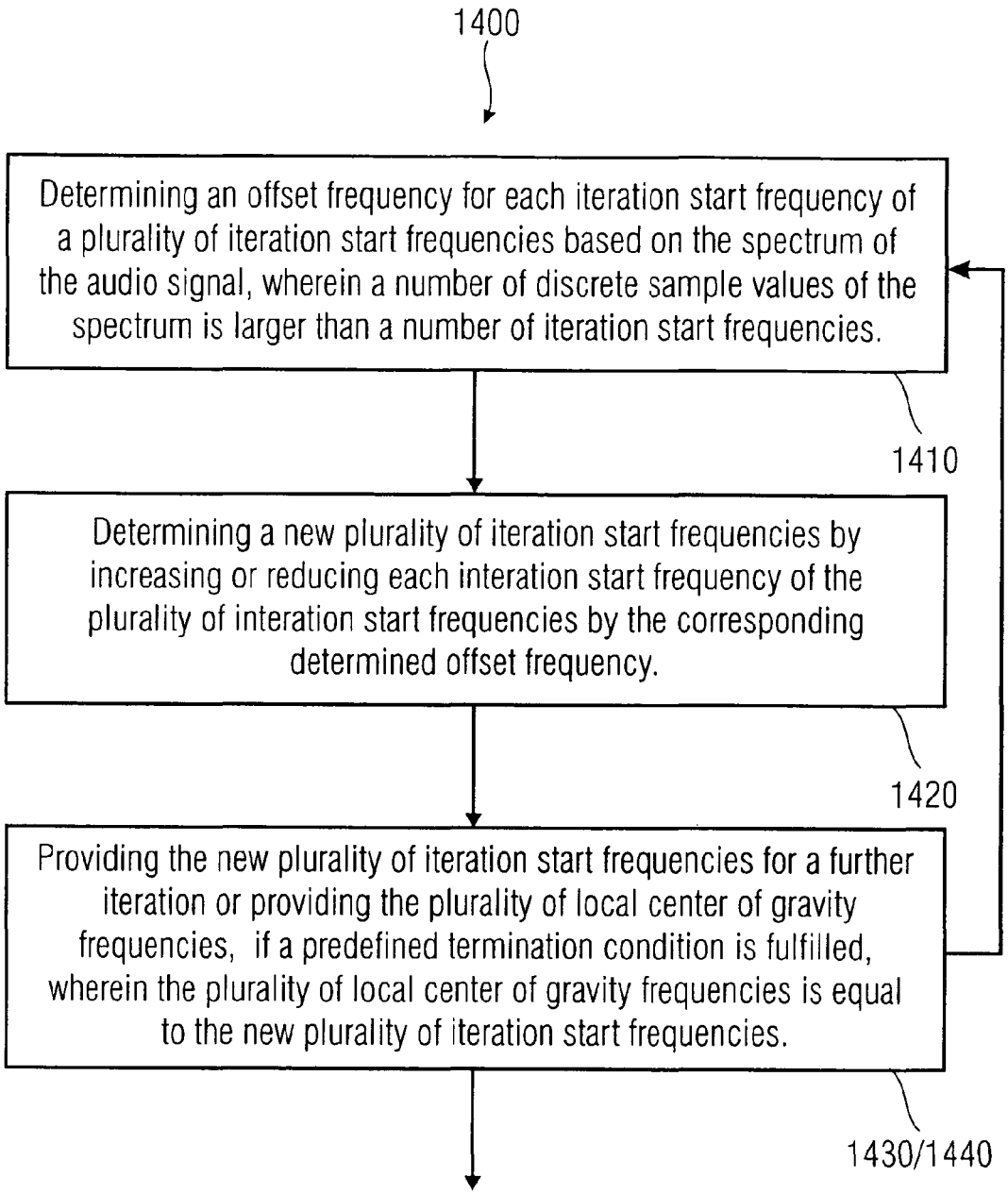
FIG. 14 is a flowchart of a method for determining a plurality of local center-of-gravity frequencies.

FIG. 14 shows a flowchart of a method 1400 for determining a plurality of local center-of-gravity frequencies of a spectrum of an audio signal according to an embodiment of the invention. The method 1400 comprises determining 1410 an offset frequency for each iteration start frequency of a plurality of iteration start frequencies, determining 1420 a new plurality of iteration start frequencies and providing 1430 the new plurality of iteration start frequencies for a further iteration or providing 1440 the plurality of local center-of-gravity frequencies. The offset frequency for each iteration start frequency of the plurality of iteration start frequencies is determined 1410 based on the spectrum of the audio signals, wherein a number of discrete sample values of the spectrum is larger than a number of iteration start frequencies. The new plurality of iteration start frequencies is determined 1420 by increasing or reducing each iteration start frequency of the plurality of iteration start frequencies by the corresponding determined offset frequency. The plurality of local center-of-gravity frequencies is provided 1440 for storage, transmission or further processing, if a predefined termination condition is fulfilled. For this, the plurality of local center-of-gravity frequencies is set equal to the new plurality of iteration start frequencies.

Some embodiments according to the invention relate to an iterative segmentation algorithm for audio signal spectra depending on estimated local centers of gravity.

Modern music production and sound generation often relies on manipulation of pre-recorded pieces of audio, so-called samples, taken from a huge database. Consequently, there is a increasing request to extensively adapt these samples to any new musical context in a flexible way. For this purpose, advanced digital signal processing is needed in order to realize audio effects like pitch shifting, time stretching or harmonization. Often, a key part of these processing methods is a signal adaptive, block based spectral segmentation operation. Hence, a novel algorithm for such a spectral segmentation based on local centers of gravity (COG) is proposed. For example, the method may be used for a multiband modulation decomposition for audio signals. Further, this algorithm can also be used in the more general context of improved vocoder related applications.

In some embodiments the segmentation algorithm proposed herein consists of an initial COG spectral position candidate list that is iteratively updated by refined estimates. In the process of refinement, addition, deletion or fusion of candidates is incorporated, thus the method does not necessitate a-priori knowledge of the total number of final COG estimates. The iteration may be implemented by two loops. All operations are performed on a spectral representation of the signal.

An important step in block based (polyphonic) music manipulation is the estimation of local centers of gravity (COG) in successive spectra over time. Motivated by the development of a signal adaptive multiband modulation decomposition, a detailed method and algorithm that estimates multiple local COG in the spectrum of an arbitrary audio signal has been proposed. Moreover, a design scheme for a set of resulting bandpass filters aligned to the estimated COG positions has been described. These filters may be utilized to subsequently separate the broadband signal into signal dependent perceptually adapted subband signals.

Exemplary results obtained by application of this method have been presented and discussed. Developed in the context of a dedicated multiband modulation decomposition scheme, the proposed algorithm can potentially be used in the more general context of audio post-processing, audio effects and improved vocoder applications.

In contrast to t-f reassignment methods, the described algorithm directly performs a spectral segmentation on a perceptually adapted scale, while t-f reassignment solely provides for a better localized spectrogram and leaves the segmentation problem to later stages, e.g. partial tracking.

In contrast to methods aiming at the estimation of multiple fundamental frequencies, the presented approach does not attempt to decompose the signal into its sources, but rather segments spectra into perceptual units which can be further manipulated conjointly.

Among other aspects, a novel multiple local COG estimation algorithm followed by the derivation of a set of bandpass filters aligned with the estimated COG positions is described. Some exemplary result data of the COG estimation and its associated set of bandpass filters is presented and discussed.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for determining a plurality of local center-of-gravity frequencies of a spectrum of an audio signal, the plurality of local center-of-gravity frequencies comprising a multitude of local center-of-gravity frequencies, the apparatus comprising:

an offset determiner configured to determine an offset frequency for each iteration start frequency of a plurality of iteration start frequencies based on the spectrum of the audio signal, wherein a number of discrete sample values of the spectrum is larger than a number of iteration start frequencies;

a frequency determiner configured to determine a new plurality of iteration start frequencies by increasing or reducing each iteration start frequency of the plurality of iteration start frequencies by the corresponding determined offset frequency; and an iteration controller configured to provide the new plurality of iteration start frequencies to the offset determiner for a further iteration or to provide the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies, wherein at least one of the offset determiner, the frequency determiner, and the iteration controller comprises a hardware implementation.

2. Apparatus according to claim 1, wherein the offset determiner is configured to determine the offset frequency for an iteration start frequency based on a plurality of discrete sample values of the spectrum, corresponding values of a weight parameter and corresponding values of a distance parameter.

3. Apparatus according to claim 2, wherein the values of the distance parameter are equally spaced from each other on a logarithmic scale, wherein all values of the distance parameter are smaller than a maximum distance value.

4. Apparatus according to claim 2, wherein the values of the weight parameter are all equal or the values of the weight parameter are decreasing for increasing absolute values of the corresponding distance parameter.

5. Apparatus according to claim 1, wherein the offset determiner is configured to determine the offset frequency for each iteration start frequency based on the spectrum, wherein the spectrum comprises a logarithmic scale.

6. Apparatus according to claim 1, wherein the apparatus is configured to determine a plurality of local center-of-gravity frequencies for each time block of a plurality of time blocks of the audio signal.

7. Apparatus according to claim 6, wherein the plurality of iteration start frequencies is initialized equally spaced from each other on a logarithmic scale for a first iteration of a time block of the plurality of time blocks.

8. Apparatus according to claim 6, wherein the plurality of iteration start frequencies for a first iteration of a time block is based on a plurality of local center-of-gravity frequencies determined for a previous time block.

9. Apparatus according to claim 6, wherein the predefined termination condition is fulfilled, if an absolute value of a sum of the frequency offset determined for a current time block and the frequency offset determined for a previous time block for each iteration start frequency is smaller than a predefined threshold offset.

10. Apparatus according to claim 1, comprising a frequency merger configured to merge two adjacent iteration start frequencies of the plurality of iteration start frequencies, if a frequency distance between the two adjacent iteration start frequencies is smaller than a minimum frequency distance.

11. Apparatus according to claim 10, wherein the frequency merger is configured to merge the two adjacent iteration start frequencies by replacing the two adjacent iteration start frequencies by a new iteration start frequency located between the two adjacent iteration start frequencies.

12. Apparatus according to claim 1, comprising a frequency remover configured to remove an iteration start frequency from the new plurality of iteration start frequencies, if the iteration start frequency is higher than a predefined maximum frequency of the spectrum of the audio signal or if the iteration start frequency is lower than a predefined minimum frequency of the spectrum of the audio signal.

13. Apparatus according to claim 1, comprising a frequency adder configured to add an iteration start frequency to the new plurality of iteration start frequencies, if a frequency distance between two adjacent iteration start frequencies of the new plurality of iteration start frequencies is larger than a maximum frequency distance.

14. Apparatus according to claim 1, comprising a preprocessor configured to generate a Fourier transformation spectrum for a time block of the audio signal, to generate a smooth spectrum based on the Fourier transformation spectrum of the time block, to generate the spectrum of the audio signal to be provided to the offset determiner by dividing the Fourier transformation spectrum with the smoothed spectrum, to map the spectrum to a logarithmic scale and to provide the logarithmic spectrum to the offset determiner, or configured to generate a Fourier transformation spectrum for a time block of the audio signal, to map the Fourier transformation spectrum to a logarithmic scale, to generate a smooth spectrum based on the logarithmic Fourier transformation spectrum of the time block, to generate the spectrum of the audio signal to be provided to the offset determiner by dividing the logarithmic Fourier transformation spectrum with the smoothed spectrum and to provide the spectrum to the offset determiner.

15. Apparatus according to claim 14, wherein the preprocessor comprises a filter configured to temporally smooth the Fourier transformation spectrum, the logarithmic Fourier transformation spectrum and/or the smoothed spectrum before dividing the Fourier transformation spectrum or the logarithmic Fourier transformation spectrum with the smoothed spectrum.

16. Signal adaptive filterbank for filtering an audio signal, comprising:

an apparatus for determining a plurality of local center-of-gravity frequencies of a spectrum of the audio signal, the plurality of local center-of-gravity frequencies comprising a multitude of local center-of-gravity frequencies, the apparatus comprising:

an offset determiner configured to determine an offset frequency for each iteration start frequency of a plurality of iteration start frequencies based on the spectrum of the audio signal, wherein a number of discrete sample values of the spectrum is larger than a number of iteration start frequencies;

a frequency determiner configured to determine a new plurality of iteration start frequencies by increasing or reducing each iteration start frequency of the plurality of iteration start frequencies by the corresponding determined offset frequency; and an iteration controller configured to provide the new plurality of iteration start frequencies to the offset determiner for a further iteration or to provide the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies; and a plurality of bandpass filters configured to filter the audio signal to acquire a filtered audio signal and to provide the filtered audio signal, wherein a center frequency and a bandwidth of each bandpass filter of the plurality of bandpass filters is based on the plurality of local center-of-gravity frequencies, wherein at least one of the bandpass filters, the offset determiner, the frequency determiner, and the iteration controller comprises a hardware implementation.

17. Signal adaptive filterbank according to claim 16, wherein each bandpass filter of the plurality of bandpass filters corresponds to a local center-of-gravity frequency, wherein the center frequency and the bandwidth of a bandpass filter depends on the corresponding local center-of-gravity frequency and the adjacent local center-of-gravity frequencies of the correlated center-of-gravity frequency.

18. Signal adaptive filterbank according to claim 16, wherein the bandwidth of the plurality of bandpass filters are determined, so that the whole spectrum is covered without holes.

19. Phase vocoder comprising a signal adaptive filterbank for filtering an audio signal, the filterbank comprising:

an apparatus for determining a plurality of local center-of-gravity frequencies of a spectrum of the audio signal, the plurality of local center-of-gravity frequencies comprising a multitude of local center-of-gravity frequencies, the apparatus comprising:

an offset determiner configured to determine an offset frequency for each iteration start frequency of a plurality of iteration start frequencies based on the spectrum of the audio signal, wherein a number of discrete sample values of the spectrum is larger than a number of iteration start frequencies;

a frequency determiner configured to determine a new plurality of iteration start frequencies by increasing or reducing each iteration start frequency of the plurality of iteration start frequencies by the corresponding determined offset frequency; and an iteration controller configured to provide the new plurality of iteration start frequencies to the offset determiner for a further iteration or to provide the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies; and a plurality of bandpass filters configured to filter the audio signal to acquire a filtered audio signal and to provide the filtered audio signal, wherein a center frequency and a bandwidth of each bandpass filter of the plurality of bandpass filters is based on the plurality of local center-of-gravity frequencies, wherein at least one of the signal adaptive filterbank, one of the plurality the bandpass filters, the offset determiner, the frequency determiner, and the iteration controller comprises a hardware implementation.

20. Apparatus for converting an audio signal into a parameterized representation, the apparatus comprising:

an apparatus for determining a plurality of local center-of-gravity frequencies of a spectrum of the audio signal, the plurality of local center-of-gravity frequencies comprising a multitude of local center-of-gravity frequencies, the apparatus comprising:

an offset determiner configured to determine an offset frequency for each iteration start frequency of a plurality of iteration start frequencies based on the spectrum of the audio signal, wherein a number of discrete sample values of the spectrum is larger than a number of iteration start frequencies;

a frequency determiner configured to determine a new plurality of iteration start frequencies by increasing or reducing each iteration start frequency of the plurality of iteration start frequencies by the corresponding determined offset frequency; and an iteration controller configured to provide the new plurality of iteration start frequencies to the offset determiner for a further iteration or to provide the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies;

a bandpass estimator for estimating information of a plurality of bandpass filters based on the plurality of local center-of-gravity frequencies, wherein the information on the plurality of bandpass filters comprises information on a filter shape for the portion of the audio signal, wherein the bandwidth of a bandpass filter is different over an audio spectrum;

a modulation estimator for estimating an amplitude modulation or a frequency modulation or a phase modulation for each band of the plurality of bandpass filters for the portion of the audio signal using the information on the plurality of bandpass filters; and an output interface for transmitting, storing or modifying information on the amplitude modulation, information on the frequency modulation or phase modulation or the information on the plurality of bandpass filters for the portion of the audio signal, wherein at least one of the bandpass estimator, the modulation estimator, the output interface, the offset determiner, the frequency determiner, and the iteration controller comprises a hardware implementation.

21. Method for determining a plurality of local center-of-gravity frequencies of a spectrum of an audio signal, the plurality of local center-of-gravity frequencies comprising a multitude of local center-of-gravity frequencies, the method comprising:

determining, by an offset determiner, an offset frequency for each iteration start frequency of a plurality of iteration start frequencies based on the spectrum of the audio signal, wherein a number of discrete sample values of the spectrum is larger than a number of iteration start frequencies;

determining, by a frequency determiner, a new plurality of iteration start frequencies by increasing or reducing each iteration start frequency of the plurality of iteration start frequencies by the corresponding determined offset frequency; and providing, by an iteration controller, the new plurality of iteration start frequencies for a further iteration or providing the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies, wherein at least one of the offset determiner, the frequency determiner, and the iteration controller comprises a hardware implementation.

22. Non-transitory storage medium having stored thereon a computer program with a program code for performing the method for determining a plurality of local center-of-gravity frequencies of a spectrum of an audio signal, the plurality of local center-of-gravity frequencies comprising a multitude of local center-of-gravity frequencies, the method comprising:

determining an offset frequency for each iteration start frequency of a plurality of iteration start frequencies based on the spectrum of the audio signal, wherein a number of discrete sample values of the spectrum is larger than a number of iteration start frequencies;

determining a new plurality of iteration start frequencies by increasing or reducing each iteration start frequency of the plurality of iteration start frequencies by the corresponding determined offset frequency; and providing the new plurality of iteration start frequencies for a further iteration or providing the plurality of local center-of-gravity frequencies, if a predefined termination condition is fulfilled, wherein a number of the multitude of local center-of-gravity frequencies of the plurality of local center-of-gravity frequencies is equal to a number of iteration start frequencies of the new plurality of iteration start frequencies, when the computer program runs on a computer or a microcontroller.

* * * * *